US010535454B2

(12) United States Patent
Okamoto et al.

(10) Patent No.: US 10,535,454 B2
(45) Date of Patent: Jan. 14, 2020

(54) COMPRESSED POWDER CORE, POWDERS FOR COMPRESSED POWER CORE, AND METHOD FOR PRODUCING COMPRESSED POWDER CORE

(71) Applicant: TOYOTA JIDOSHA KABUSHIKI KAISHA, Toyota-shi, Aichi (JP)

(72) Inventors: Daisuke Okamoto, Toyota (JP); Toshimitsu Takahashi, Toyota (JP); Sinjiro Saigusa, Toyota (JP); Kohei Ishii, Nagoya (JP); Naoki Iwata, Toyota (JP); Jung Hwan Hwang, Nagakute (JP); Masashi Ohtsubo, Nagakute (JP); Takeshi Hattori, Nagakute (JP); Masashi Hara, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/291,350

(22) Filed: Oct. 12, 2016

(65) Prior Publication Data

US 2017/0110227 A1 Apr. 20, 2017

(30) Foreign Application Priority Data

Oct. 14, 2015 (JP) ..... 2015-202971

(51) Int. Cl.
*H01F 3/08* (2006.01)
*H01F 1/147* (2006.01)
(Continued)

(52) U.S. Cl.
CPC ..... *H01F 1/14791* (2013.01); *H01F 1/24* (2013.01); *H01F 1/28* (2013.01); *H01F 3/08* (2013.01); *H01F 41/0246* (2013.01)

(58) Field of Classification Search
CPC ..... H01F 3/08
See application file for complete search history.

(56) References Cited

U.S. PATENT DOCUMENTS 7,083,760 B2 8/2006 Kondo et al.
9,941,039 B2 4/2018 Okamoto et al.
(Continued)

FOREIGN PATENT DOCUMENTS

JP 2002-141213 A 5/2002
JP 3309970 B2 7/2002
(Continued)

OTHER PUBLICATIONS

Non-Final Office Action dated Mar. 22, 2019, issued by USPTO in U.S. Appl. No. 15/500,957.
(Continued)

*Primary Examiner* — Elvin G Enad
*Assistant Examiner* — Malcolm Barnes
(74) *Attorney, Agent, or Firm* — Sughrue Mion, PLLC

(57) ABSTRACT

Provided is a compressed powder core that can suppress a decrease in the inductance even when a high magnetic field (of greater than or equal to 40 kA/m) is applied to the compressed powder core while suppressing an iron loss and a decrease in the strength of the compressed powder core. The compressed powder core 1A has soft magnetic particles 11A and aluminum nitride layers 12A formed on the surface layers of the respective soft magnetic particles 11A. The compressed powder core 1A has a ratio of the first differential relative permeability μ'L to the second differential relative permeability μ'H satisfying a relationship of μ'L/μ'H≤6, and has a magnetic flux density of greater than or equal to 1.4 T when a magnetic field of 60 kA/m is applied. The soft magnetic particles of the compressed powder core 1A contain Si in the range of 1.0 to 3.0 mass % and have,
(Continued)

when analyzed using XRD, a peak area ratio Sal/Sfe of greater than or equal to 4%, the peak area ratio Sal/Sfe being the ratio of the area Sal of a peak waveform derived from AlN to the area Sfe of a peak waveform derived from Fe.

5 Claims, 12 Drawing Sheets

(51) Int. Cl.
*H01F 1/24* (2006.01)
*H01F 1/28* (2006.01)
*H01F 41/02* (2006.01)

(56) References Cited

U.S. PATENT DOCUMENTS

2002/0034453 A1 3/2002 Kondo et al.
2002/0043303 A1 4/2002 Takemoto et al.
2002/0097124 A1* 7/2002 Inoue ..... H01F 1/24 336/83
2011/0024671 A1* 2/2011 Otsuki ..... B22F 1/02 252/62.54
2012/0092106 A1* 4/2012 Takahashi ..... B22F 1/0062 335/302
2012/0326830 A1* 12/2012 Oshima ..... H01F 1/26 336/221
2013/0015939 A1* 1/2013 Inagaki ..... B22F 1/02 336/233
2013/0136933 A1* 5/2013 Matsutani ..... C22C 38/14 428/446
2013/0228716 A1* 9/2013 Suetsuna ..... C22C 29/12 252/62.55
2013/0228717 A1* 9/2013 Harada ..... H01F 1/26 252/62.55
2014/0374644 A1* 12/2014 Eguchi ..... H01F 1/28 252/62.54
2015/0287507 A1* 10/2015 Nishio ..... H01F 1/26 335/297
2015/0364235 A1 12/2015 Okamoto et al.
2016/0071636 A1 3/2016 Ohtsubo et al.
2016/0086705 A1* 3/2016 Eguchi ..... H01F 27/255 252/62.54
2016/0086717 A1* 3/2016 Harada ..... H01F 27/255 336/233
2017/0263359 A1 9/2017 Ohtsubo et al.

FOREIGN PATENT DOCUMENTS

JP 2003243215 A 8/2003
JP 2004-253787 A 9/2004
JP 2006-233268 A 9/2006
JP 2006233268 A * 9/2006
JP 4024705 B2 12/2007
JP 2008-297622 A 12/2008
JP 2009-296015 A 12/2009
JP 2012049203 A * 3/2012 ..... H01F 1/24
JP 2012049203 A 3/2012
JP 2013-171967 A 9/2013
JP 2013171967 A * 9/2013
WO 2016/039267 A1 3/2016

OTHER PUBLICATIONS

Notice of Allowance dated Jul. 22, 2019, issued by the USPTO in U.S. Appl. No. 15/500,957.

* cited by examiner

COMPRESSED POWDER CORE, POWDERS FOR COMPRESSED POWER CORE, AND METHOD FOR PRODUCING COMPRESSED POWDER CORE

CLAIM OF PRIORITY

The present application claims priority from Japanese patent application JP 2015-202971 filed on Month Date, Year, the content of which is hereby incorporated by reference into this application.

BACKGROUND

Technical Field

The present invention relates to a compressed powder core with excellent magnetic properties, powders for the compressed powder core, and a method for producing the compressed powder core.

Background Art

Conventionally, reactors have been used for hybrid vehicles, electric vehicles, photovoltaic power generating systems, and the like. Such reactors adopt a structure in which a coil is wound around a ring-shaped core that is a compressed powder core. When such a reactor is used, a magnetic field of at least 40 kA/m is applied to the core to flow a wide range of current through the coil. Even under such an environment, it is necessary to stably secure the inductance of the reactor.

In view of the forgoing, a reactor 9 illustrated in FIG. 13A has been proposed, for example (see Patent Document 1, for example). The reactor 9 has a ring-shaped core (i.e., compressed powder core) 91 that are split in two, gaps 93 provided between the split cores 92A and 92B, and coils 95A and 95B wound around portions of the core 91 including the gaps 93.

According to such a reactor 9, as the gaps 93 are provided between the split cores 92A and 92B, even when a wide range of current is flowed through the coils 95A and 95B of the reactor 9, it is possible to secure a stable inductance in such a current range.

By the way, compressed powder cores are also used for choking coils, inductors, and the like. As such compressed powder cores, a compressed powder core is disclosed that satisfies, provided that the initial permeability is $\mu_0$ and the permeability when a magnetic field of 24 kA/m is applied is a relationship of $\mu/\mu_0 \geq 0.5$ between $\mu_0$ and $\mu$ (see Patent Document 2, for example). According to such a compressed powder core, it is possible to suppress a decrease in the permeability of the compressed powder core even when a high magnetic field is applied thereto.

RELATED ART DOCUMENTS

Patent Documents

Patent Document 1: JP 2009-296015 A
Patent Document 2: JP 2002-141213A

SUMMARY

However, in the case of the technique shown in Patent Document 1, for example, as the gaps are formed between the split cores, a leakage of a magnetic flux T occurs in the gaps 93 that are formed between the split cores 92A and 92B as illustrated in FIG. 13B. In particular, in the case of a reactor of a hybrid vehicle or the like through which a large current flows, a high magnetic field of greater than or equal to 40 kA/m is applied to a core. Therefore, in order to maintain the inductance of the reactor (that is, the core) when such a high magnetic field is applied, the aforementioned gaps are further widened. Accordingly, there have been cases where a leakage of the magnetic flux T from the gaps would increase, and the leaked magnetic flux would be linked with the coil, which can result in the generation of an eddy current loss in the coil.

The aforementioned problem with a reactor is only exemplary. In a device or an apparatus in which a magnetic field of a low level to a high level (40 kA/m) is applied to a compressed powder core, it is difficult to maintain the inductance, and some measures have been typically taken for the structure of the device or the apparatus.

Even when a compressed powder core with the characteristics shown in Patent Document 2 is used, it is not supposed that a high magnetic field of greater than or equal to 40 kA/m would be applied. Therefore, it is supposed that even when such a material is used, the inductance would significantly decrease if a high magnetic field (of greater than or equal to 40 kA/m) is applied. In addition, a decrease in the strength of the compressed powder core as well as a decrease in the saturation magnetic flux density is also concerned.

The present invention has been made in view of the foregoing. The present invention provides a compressed powder core, powders for the compressed powder core, and a method for producing the compressed powder core that can suppress a decrease in the inductance even when a high magnetic field (of greater than or equal to 40 kA/m) is applied to the compressed powder core while suppressing an iron loss and a decrease in the strength of the compressed powder core.

The inventors have conducted concentrated studies and found that in order to suppress a decrease in the inductance even when a high magnetic field is applied, it is important to secure a predetermined magnitude of a magnetic flux density even when a high magnetic field is applied, by maintaining a high content of an iron group and to suppress the differential relative permeability when a low magnetic field is applied. Thus, the inventors focused on the ratio between the differential relative permeability when a particular low magnetic field is applied and the differential relative permeability when a particular high magnetic field is applied, and found that it is important to reduce an iron loss and secure the strength of the compressed powder core while satisfying the relationship of the ratio.

The present invention is based on the findings of the inventors, and a compressed powder core in accordance with the present invention is a compressed powder core including soft magnetic particles each having a base material made of an Fe—Si—Al alloy and an aluminum nitride layer formed on the surface layer of the base material, and a low-melting glass layer between the soft magnetic particles, the low-melting glass layer having a softening point lower than an annealing temperature of the soft magnetic particles for annealing the compressed powder core. The compressed powder core has, provided that the differential relative permeability when a magnetic field of 1 kA/m is applied is a first differential relative permeability $\mu'L$ and the differential relative permeability when a magnetic field of 40 kA/m is applied is a second differential relative permeability $\mu'H$, a ratio of $\mu'L$ to $\mu'H$ satisfying a relationship of $\mu'L/\mu'H \leq 6$, and has a magnetic flux density of greater than or equal to 1.4 T when a magnetic field of 60 kA/m is applied. The soft magnetic particles contain Si in the range of 1.0 to 3.0 mass %. The compressed powder core has, when analyzed using XRD, a peak area ratio Sal/Sfe of greater than or equal to 4%, the peak area ratio Sal/Sfe being the ratio of the area Sal of a peak waveform derived from AlN to the area Sfe of the peak waveform derived from Fe.

According to the compressed powder core of the present invention, as long as the ratio of the first differential relative permeability μ'L to the second differential relative permeability μ'H satisfies a relationship of μ'L/μ'H≤6, it is possible to maintain the gradient of the B-H curve of the compressed powder core to be larger than those of the conventional products even when a high magnetic field is applied. Accordingly, it is possible to suppress the fluctuations in the inductance of the compressed powder core even when the magnetic field applied to the compressed powder core is changed from a low level (1 kA/m) to a high level (40 kA/m).

Herein, if μ'L/μ'H>6, the difference between the differential relative permeability when a low magnetic field is applied and that when a high magnetic field is applied would become large, and thus, when a high magnetic field is applied to the compressed powder core, the inductance would significantly decrease. For example, when split cores are used for a reactor, it would be impossible to maintain the inductance of the reactor without increasing the gaps between the split cores. Consequently, a leakage of a magnetic flux from the gaps would increase, and the leaked magnetic flux would be linked with the coil, which can result in the generation of an eddy current loss in the coil. It should be noted that μ'L/μμ'H is preferably as small as possible, but the lower limit is 1. It is difficult to produce a compressed powder core where μ'L/μ'H <1.

In addition, as a magnetic flux density of greater than or equal to 1.4 T is secured when a magnetic field of 60 kA/ is applied, it is possible to maintain the inductance value when a magnetic field of a low level to a high level is applied. That is, if the magnetic flux density when a magnetic field of 60 kA/m is applied is less than 1.4 T, the size of a device, such as a reactor, should be increased to obtain a desired inductance. The upper limit of the magnetic flux density when a magnetic field of 60 kA/m is applied is preferably 2.1 T. As the saturation magnetic flux density of pure iron is about 2.2 T, it is difficult to produce a compressed powder core with a magnetic flux density higher than that.

Herein, the "differential relative permeability" as referred to in the present invention is the value obtained by dividing the inclination of a tangent to a curve (B-H curve) of the magnetic field H and the magnetic flux density B, which is obtained when a magnetic field is applied to a compressed powder core in a continuously increasing manner, by the space permeability. For example, the differential relative permeability (i.e., second differential relative permeability μ'H) when a magnetic field of 40 kA/m is applied is the value obtained by dividing the inclination of a tangent to the B-H curve corresponding to the applied magnetic field of 40 kA/m by the space permeability.

In addition, as the soft magnetic particles each have an aluminum nitride layer, which is harder than the base material, on the surface layer of the base material, the distance between the soft magnetic particles after molding is secured, and the aluminum nitride layers, which are nonmagnetic materials, are thus held between such soft magnetic particles.

The soft magnetic particles that form the compressed powder core contain Si in the range of 1.0 to 3.0 mass %. If the Si content is less than 1.0 mass %, an iron loss of the compressed powder core will increase. Meanwhile, if the Si content is over 3.0 mass %, the relationship of the peak area ratio of Sal/Sfe≥4% (described below) is not satisfied, that is, the aluminum nitride layers become thin. Thus, μ'L cannot be sufficiently low.

In addition, the compressed powder core has, when analyzed using XRD, a peak area ratio Sal/Sfe, which is the ratio of the area Sal of the peak waveform derived from AlN to the area Sfe of the peak waveform derived from Fe, of greater than or equal to 4%. When such a relationship is satisfied, the nonmagnetic aluminum nitride layers become thick. Thus, the distance between the soft magnetic particles can be secured and μ'L can be reduced. In addition, the wettability and compatibility of the low-melting glass layer with the aluminum nitride layers of the soft magnetic particles is improved, and the strength of the compressed powder core can thus be increased.

As a preferable feature of the compressed powder core of the present invention, when the total mass of the entire compressed powder core is assumed to be 100 mass %, the content of the low-melting glass that forms the low-melting glass layer is 0.05 to 5.0 mass %. If the content of the low-melting glass is less than 0.05 mass %, a sufficient low-melting glass layer may not be formed, and a compressed powder core with a high specific resistance and high strength may not be obtained accordingly. Meanwhile, if the content of the low-melting glass is over 5.0 mass %, the magnetic properties of the compressed powder core may decrease.

As the present invention, powders for a compressed powder core that are suitable for producing the aforementioned compressed powder core are also disclosed. Powders for a compressed powder core in accordance with the present invention are powders for a compressed powder core that include soft magnetic powders each having a base material made of an Fe—Si—Al alloy and an aluminum nitride layer formed on the surface layer of the base material, and low-melting glass films formed on the surfaces of the respective soft magnetic powders, the low-melting glass films having a softening point lower than an annealing temperature of the soft magnetic powders for annealing the compressed powder core. The soft magnetic powders contain, when the total mass of the entire soft magnetic powders is assumed to be 100 mass %, Si in the range of 1.0 to 3.0 mass %. The powders for the compressed powder core have, when analyzed using XRD, a peak area ratio Sal/Sfe of greater than or equal to 4%, the peak area ratio Sal/Sfe being the ratio of the area Sal of a peak waveform derived from AlN to the area Sfe of a peak waveform derived from Fe.

According to the present invention, as the soft magnetic powders each have an aluminum nitride layer, which is harder than the base material, on the surface layer of the base material, it is possible to secure the distance between the soft magnetic particles of the compressed powder core that is molded from the powders for the compressed powder core, and thus hold the nonmagnetic aluminum nitride layers therebetween. Accordingly, it becomes easier to produce a compressed powder core that satisfies the aforementioned relationship of μ'L/μ'H as well as the aforementioned range of the magnetic flux density.

The soft magnetic powders contain, when the total mass of the entire soft magnetic powders is assumed to be 100 mass %, Si in the range of 1.0 to 3.0 mass %. As described above, if the Si content is less than 1.0 mass %, an iron loss of the compressed powder core will increase, while if the Si content is over 3.0 mass %, it is difficult to produce soft magnetic powders that satisfy the relationship of a peak area ratio of Sal/Sfe≥4% described below.

Further, as the powders for the compressed powder core satisfy the relationship of a. peak area ratio of Sal/Sfe≥4%, it is possible to improve the wettability and compatibility of the low-melting glass (i.e., low-melting glass films) with the aluminum nitride layers of the compressed powder core that is molded from the powders for the compressed powder core, and thus increase the strength of the compressed powder core.

As the present invention, a method for producing the aforementioned compressed powder core is also disclosed. The method for producing a compressed powder core in accordance with the present invention includes a step of preparing soft magnetic powders made of a Fe—Si—Al alloy, the soft magnetic powders containing, when the total mass of the entire soft magnetic powders is assumed to be 100 mass %, Si in the range of 1.0 to 3.0 mass %, and having an Al ratio of greater than or equal to 0.45, the Al ratio being the mass proportion of Al to the total mass of Al and Si; a nitriding treatment step of nitriding the prepared soft magnetic powders by heating the soft magnetic powders under a nitrogen gas atmosphere so that the nitrided soft magnetic powders have, when analyzed using XRD, a peak area ratio Sal/Sfe of greater than or equal to 4%, the peak area ratio Sal/Sfe being the ratio of the area Sal of a peak waveform derived from MN to the area Sfe of a peak waveform derived from Fe; a step of adding low-melting glass to the nitrided soft magnetic powders, the low-melting glass having a softening point lower than an annealing temperature for annealing the compressed powder core, thereby forming low-melting glass films made of the low-melting glass so as to cover the surfaces of the respective soft magnetic powders and thus producing the powders for the compressed powder core; and a step of molding a compressed powder core from the powders for the compressed powder core each having the low-melting glass film formed thereon, and then annealing the compressed powder core.

According to the present invention, as the nitriding treatment is applied to the soft magnetic powders, which contain Si in the aforementioned range and have an Al ratio of greater than or equal to 0.45, it is possible to form aluminum nitride layers on the surfaces of the respective soft magnetic powders so that the peak area ratio Sal/Sfe becomes greater than or equal to 4%.

Herein, if the Al ratio of the soft magnetic powders is less than 0.45, aluminum nitride layers are not formed on the surfaces of the soft magnetic powders in the nitriding treatment step. Meanwhile, if the Si content is over 3.0 mass %, it is difficult to produce soft magnetic powders that satisfy the relationship of a peak area ratio of Sal/Sfe≥4%. It should be noted that as described above, if the Si content is less than 1.0 mass %, an iron loss of the produced compressed powder core will increase.

Low-melting glass films are formed on the respective nitrided soft magnetic powders to produce powders for a compressed powder core. Then, a compressed powder core is molded from such powders for the compressed powder core, and then, the compressed powder core is annealed. As the low-melting glass is softened by annealing, it is possible to form a low-melting glass layer between the soft magnetic particles of the compressed powder core. In particular, as the powders for the compressed powder core satisfy the relationship of a peak area ratio of Sal/Sfe≥4%, it is possible to improve the wettability and compatibility of the low-melting glass layer with the aluminum nitride layers of the compressed powder core that is molded from the powders for the compressed powder core, and thus increase the strength of the compressed powder core.

As a further preferable feature, the nitriding treatment step includes heating the soft magnetic powders at 800° C., or greater for 0.5 hour or longer. Accordingly, soft magnetic powders that satisfy the peak area ratio Sal/Sfe can be easily obtained.

In addition, it is preferable to use such a compressed powder core as a core and wind a coil around the core to form a reactor. Such a reactor can, even when a small current to a large current is flowed through the coil, maintain the inductance. Thus, it is not necessary to split the core or, even when the coil is split, suppress the gaps between the split cores. Consequently, it is possible to eliminate or reduce an eddy current loss in the coil due to a leakage of a magnetic flux.

According to the present invention, it is possible to suppress a decrease in the inductance of a compressed powder core even when a high magnetic field (of about 40 kA/m) is applied to the compressed powder core while suppressing an iron loss and a decrease in the strength of the compressed powder core.

BRIEF DESCRIPTION OF THE DRAWINGS

FIG. 1A illustrates soft magnetic powders, FIG. 1B illustrates nitrided soft magnetic powders, FIG. 1C illustrates powders for a compressed powder core, and FIG. 1D illustrates the states of soft magnetic particles of a molded body.

FIG. 3A illustrates soft magnetic powders, FIG. 3B illustrates powders for a compressed powder core, and FIG. 3C illustrates the states of soft magnetic particles of a molded body.

DETAILED DESCRIPTION

Hereinafter, powders for a compressed powder core, the compressed powder core, and a method for producing the compressed powder core in accordance with the present invention will be described based on an embodiment with reference to the drawings.

1. Regarding Powders for a Compressed Powder Core and a Method for Producing the Powders 1.1 Regarding Soft Magnetic Powders 11'

Figure 1A:
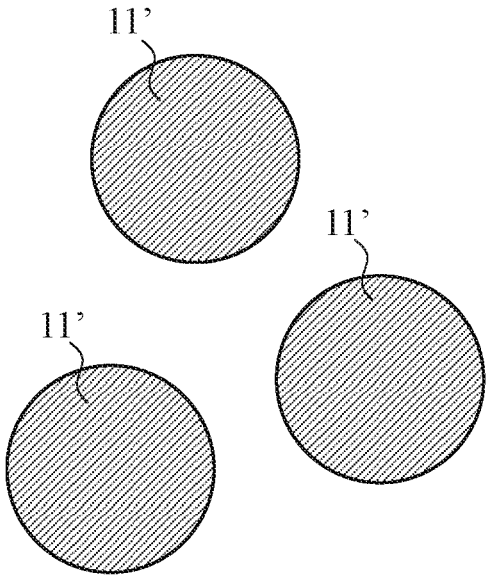
FIGS. 1A to 1D are schematic views illustrating a method for producing a compressed powder core in accordance with an embodiment of the present invention; specifically.

Soft magnetic powders 11' illustrated in FIG. 1A are soft magnetic powders (i.e., particles) made of a Fe—Si—Al alloy (i.e., iron alloy) and are used as an aggregate. The soft magnetic powders 11' are subjected to nitriding treatment for producing powders (i.e., particles) 1 for a compressed powder core (see FIG. 1B).

The soft magnetic powders 11' contain Si in the range of 1.0 to 3.0 mass % relative to the entirety of the powders (i.e., entire powders) (assuming that the total mass of the entire soft magnetic powders 11' is 100 mass %). If the Si content is less than 1.0 mass %, an iron loss of a compressed powder core 1A would increase due to the deterioration of the magnetocrystalline anisotropy. Meanwhile, if the Si content is over 3.0 mass %, it becomes difficult to form aluminum nitride layers 12 with a desired thickness in the nitriding treatment described below.

Further, the Al ratio (Al/Al+Si), which is the mass proportion of Al to the total mass of Al and Si, of the soft magnetic powders 11' is greater than or equal to 0.45. Herein, if the Al ratio is less than 0.45, it becomes difficult to form the aluminum nitride layers 12 in the nitriding treatment as is obvious from the experiments conducted by the inventors described below. It should be noted that when the magnetic properties are taken into consideration, the upper limit of the Al ratio is preferably less than or equal to 1, and more preferably, less than or equal to 0.9. Further, the total mass of Al and Si is preferably less than or equal to 10 mass % when the total mass of the entire Fe—Si—Al alloy (i.e., iron alloy) is assumed to be 100 mass %.

The particle size (median size $D_{50}$) of each soft magnetic powder (i.e., particle) 11' is not particularly limited, but is typically and preferably 30 to 80 μm. If the particle size is less than 30 μm, a hysteresis loss of the compressed powder core 1A would increase and the productivity would thus be lost. Further, if the particle size is over 80 μm, an eddy current loss of the compressed powder core 1A may increase and the strength of the compressed powder core 1A may thus decrease.

Examples of the soft magnetic powders 11' include water atomized powders, gas atomized powders, and pulverized powders. In order to suppress the crash of the aluminum nitride layers 12 during powder compression molding, it is preferable to select powders with few irregularities on their surfaces for the soft magnetic powders 11'.

1-2. Formation of the Aluminum Nitride Layers 12 (i.e., Nitriding Treatment)

Figure 1B:
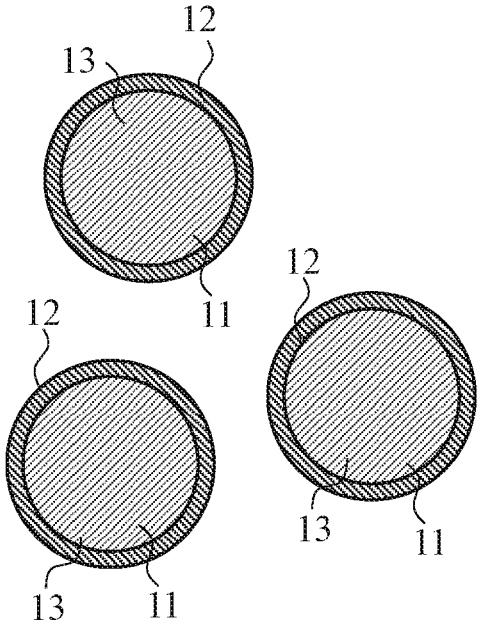
Figure 1C:
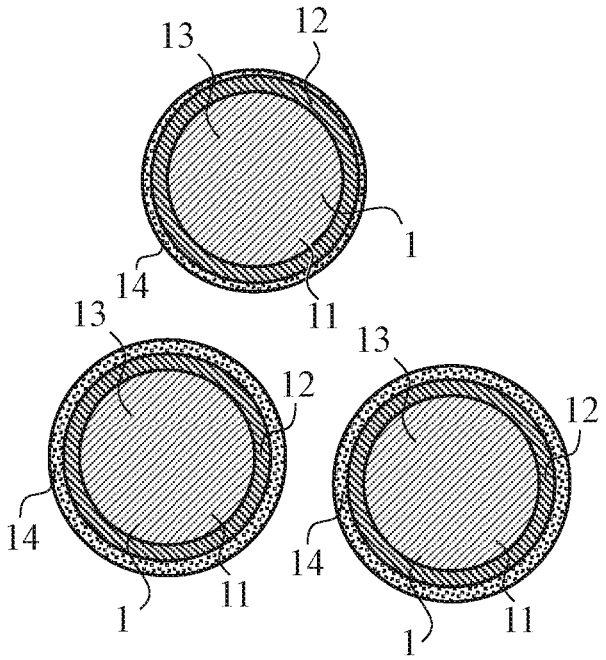

The soft magnetic powders 11' illustrated in FIG. 1A are subjected to nitriding treatment, whereby the aluminum nitride layers (AlN) 12 are formed on the surfaces of the respective soft magnetic powders 11'. Accordingly, as illustrated in FIG. 1B, soft magnetic powders 11, each having a base material 13 made of a Fe—Si—Al alloy and the aluminum nitride layer 12 formed on the surface thereof, can be obtained.

Herein, as described above, as the Si content of the soft magnetic powders 11 is limited to less than or equal to 3 mass %, the stabilization of the α phase of the iron alloy in the nitriding treatment can be suppressed. If the α phase becomes stable, the solid solution diffusion of N becomes small, and thus, the aluminum nitride layers 12 with a desired thickness cannot be formed.

Nitriding treatment is preferably performed by applying heat in the range of 800 to 1200° C. in a nitrogen gas atmosphere, and the heating time is preferably about 0.5 to 10 hours, for example. In this embodiment, nitriding treatment for the soft magnetic powders 11' is performed with the gas concentration, heating temperature, heating time, and the like of the nitrogen gas adjusted so as to satisfy the relationship of the peak area ratio Sal/Sfe indicated below.

Figure 2A:
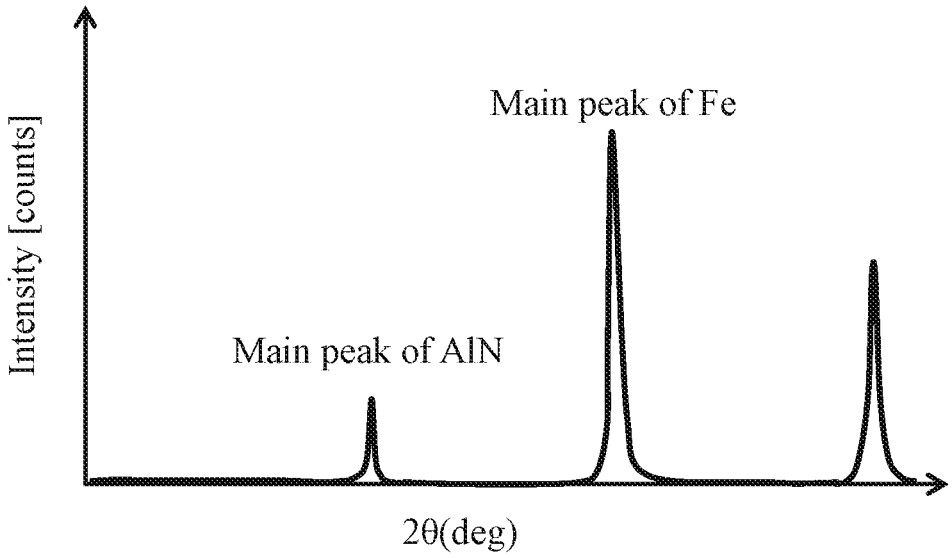
FIG. 2A illustrates the waveform of soft magnetic powders obtained through analysis with XRD.
Figure 2B:
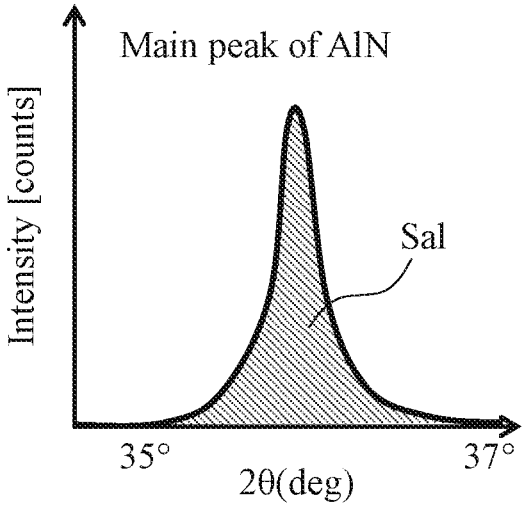
FIG. 2B illustrates a peak waveform derived from AlN.
Figure 2C:
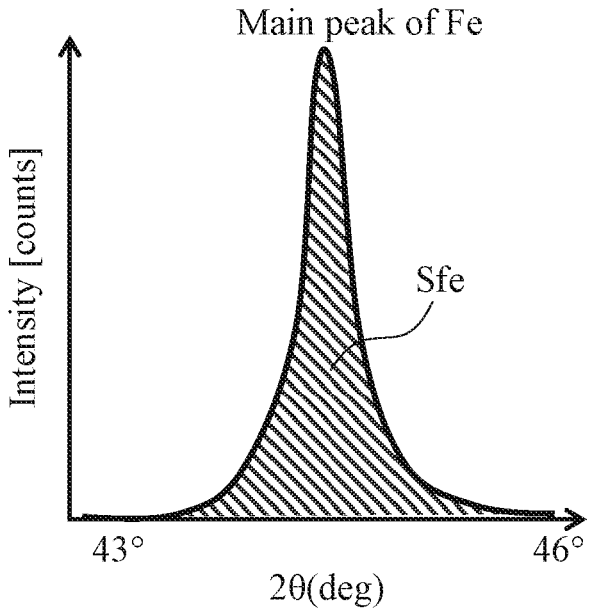
FIG. 2C illustrates a peak waveform derived from Fe.

Specifically, when the soft magnetic powders 11 obtained through the nitriding treatment are analyzed using XRD, the waveform shown in FIG. 2A can be obtained. From the obtained waveform, the area Sal of a peak waveform derived from AlN and the area Sfe of a peak waveform derived from Fe are calculated as illustrated in FIGS. 2B and 2C, respectively, so that the peak area ratio Sal/Sfe is calculated.

Specifically, in the analysis using XRD, the peak waveform derived from AlN is in the range of the measured angles of 2θ=35 to 37 degrees, and the area Sal of the peak waveform in such a range is calculated. Meanwhile, the peak waveform derived from Fe is in the range of the measured angles of 2θ=43 to 46 degrees, and the area Sfe of the peak waveform in such a range is calculated.

In this embodiment, the soft magnetic powders 11 obtained through the nitriding treatment have a peak area ratio Sal/Sfe, which is the ratio of the area Sal of the peak waveform derived from AlN to the area Sfe of the peak waveform derived from Fe, satisfying a relationship of greater than or equal to 4%. Such a relationship is the same for powders for a compressed powder core that have low-melting glass films formed thereon as described below. It should be noted that the magnitude of the peak area ratio Sal/Sfe is approximately directly proportional to the thickness of the aluminum nitride layer 12 formed on each soft magnetic powder 11 as determined through Auger spectroscopy analysis (AES) described below. The peak area ratio Sal/Sfe that is greater than or equal to 4% corresponds to the thickness of the aluminum nitride layer that is greater than or equal to 580 nm.

In this embodiment, as the relationship of the peak area ratio Sal/Sfe of greater than or equal to 4% is satisfied, the aluminum nitride layer 12 is uniformly formed on the surface layer of each soft magnetic powder 11. Accordingly, it is considered that the wettability and compatibility with a low-melting glass film 14 described below are improved and the strength of the resulting compressed powder core 1A is thus increased. In addition, as the aluminum content in the base material 13 is reduced by the formation of the aluminum nitride layer 12, powder compression moldability is increased with an increase in the plastic deformability of the base material 13, and the compressed powder core 1A with high density (i.e., high strength) can thus be obtained.

1-3. Regarding the Formation of the Low-Melting Glass Film 14

Next, low-melting glass with a softening point lower than the annealing temperature for annealing the compressed powder core is added to the soft magnetic powders 11 (i.e., base material 13) obtained through the nitriding treatment, whereby the low-melting glass films 14 are formed on the surfaces of the respective soft magnetic powders 11. Accordingly, the powders 1 for the compressed powder core can be produced.

Examples of the low-melting glass herein include silicate glass, borate glass, bismuth silicate glass, borosilicate glass, vanadium oxide glass, and phosphate glass. Such low-melting glass has a softening point lower than the annealing temperature of the soft magnetic powders (i.e., soft magnetic particles) for annealing the compressed powder core 1A.

Examples of the silicate glass include glass that contains $SiO_2$—ZnO, $SiO_2$—$Li_2O$, $SiO_2$—$Na_2O$, $SiO_2$—CaO, $SiO_2$—MgO, $SiO_2$—$Al_2O_3$, as a main component. Examples of the bismuth silicate glass include glass that contains $SiO_2$—$Bi_2O_3$—ZnO, $SiO_2$—$Bi_2O_3$—$Li_2O$, $SiO_2$—$Bi_2O_3$—$Na_2O$, $SiO_2$—$Bi_2O_3$—CaO, or the like as a main component. Examples of the borate glass include glass that contains $B_2O_3$—ZnO, $B_2O_3$—$Li_2O$, $B_2O_3$—$Na_2O$, $B_2O_3$—CaO, $B_2O_3$—MgO, $B_2O_3$—$Al_2O_3$, or the like as a main component. Examples of the borosilicate glass include glass that contains $SiO_2$—$B_2O_3$—ZnO, $SiO_2$—$B_2O_3$—$Li_2O$, $SiO_2$—$B_2O_3$—$Na_2O$, $SiO_2$—$B_2O_3$—CaO, or the like as a main component. Examples of the vanadium oxide glass include glass that contains $V_2O_5$—$B_2O_3$, $V_2O_5$—$B_2O_3$—$SiO_2$, $V_2O_5$—$P_2O_5$, $V_2O_5$—$B_2O_3$—$P_2O_5$, or the like as a main component. Examples of the phosphate glass include glass that contains $P_2O_5$—$Li_2O$, $P_2O_5$—$Na_2O$, $P_2O_5$—CaO, $P_2O_5$MgO, $P_2O_5$—$Al_2O_3$, or the like as a main component.

The content of the low-melting glass is preferably 0.05 to 5.0 mass % when the total mass of the entirety (i.e., aggregate) of the powders 1 for the compressed powder core or the entire compressed powder core 1A is assumed to be 100 mass %. If the content of the low-melting glass is less than 0.05 mass %, the low-melting glass films 14 may not be formed sufficiently, and the compressed powder core 1A with high specific resistance and high strength may thus not be obtained accordingly. Meanwhile, if the content of the low-melting glass is over 5.0 mass %, the magnetic properties of the compressed powder core 1A can deteriorate.

Herein, each low-melting glass film 14 may be a layer that has been stuck to the surface of each soft magnetic powder 11 as particles of a smaller particle size than that of the soft magnetic powder (i.e., particle) 11, or a layer that is continuously stuck to the surface of the soft magnetic powder 11. For example, in order to form the low-melting glass films 14, it is also possible to mix fine particle powders of low-melting glass with the soft magnetic powders 11 in a dispersion medium and dry them, or allow low-melting glass, which has been softened by heating, to stick to the soft magnetic powders (i.e., particles) 11. Alternatively, it is also possible to bind fine particle powders of low-melting glass and the soft magnetic powders 11 together using a binder such as PVA or PVB.

2. Regarding a Method for Producing the Compressed Powder Core 1A

The obtained powders 1 for the compressed powder core are subjected to powder compression molding to produce the compressed powder core 1A, which is then annealed through heat treatment. In this embodiment, the compressed powder core 1A may be formed from an aggregate of the powders 1 for the compressed powder core using commonly known warm die lubrication molding, for example.

The molded compressed powder core 1A is annealed at an annealing temperature of greater than or equal to 600° C., for example. Accordingly, it is possible to remove the residual strain and the residual stress that have been introduced into soft magnetic particles 11A in the compressed powder core and thus reduce the coercive force or a hysteresis loss of the compressed powder core 1A. Further, in this embodiment, as the low-melting glass is softened by annealing, it is possible to form a low-melting glass layer 14A between the soft magnetic particles 11A. In this embodiment, as the aforementioned peak area ratio Sal/Sfe is greater than or equal to 4%, it is possible to improve the wettability and compatibility of the low-melting glass layer 14A with the aluminum nitride layers 12A of the soft magnetic particles 11A, and thus increase the strength of the resulting compressed powder core.

3. Regarding the Compressed Powder Core 1A

Figure 1D:
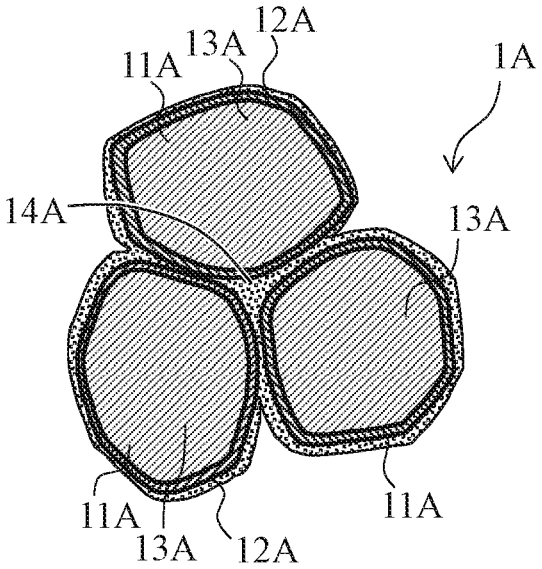

The obtained compressed powder core 1A has, as illustrated in FIG. 1D, soft magnetic particles 11A, each including the base material 13A made of a Fe—Si—Al alloy and the aluminum nitride layer 12A formed on the surface layer thereof, and the low-melting glass layer 14A formed between the soft magnetic particles 11A, 11A. Herein, the compressed powder core 1A has a ratio of the first differential relative permeability $\mu'L$ to the second differential relative permeability $\mu'H$ satisfying a relationship of $\mu'L/\mu'H \leq 6$, and has a magnetic flux density of greater than or equal to 1.4 T when a magnetic field of 60 kA/m is applied.

In addition, as is obvious from the aforementioned production method, the soft magnetic particles 11A contain Si in the range of 1.0 to 3.0 mass %, and satisfy, when the compressed powder core 1A is analyzed using XRD, the relationship of a peak area ratio Sal/Sfe, which is the ratio of the area Sal of the peak waveform derived from AlN to the area Sfe of the peak waveform derived from Fe, of greater than or equal to 4%.

It should be noted that as each powder 1 for the compressed powder core has an aluminum nitride layer formed thereon, the obtained compressed powder core 1A can satisfy the aforementioned relationship of $\mu'L/\mu'H \leq 6$ and have a magnetic flux density in the aforementioned range as long as the aforementioned molding conditions and annealing conditions are set properly.

That is, as the aluminum nitride layers 12A, which are harder than the base materials 13A, are provided as illustrated in FIG. 1D, it is unlikely that aluminum nitride will be unevenly distributed at the boundary portion (triple point) of the base materials 13A of the three soft magnetic particles 11A. Accordingly, the distance between the soft magnetic particles 11A after molding is secured, and nonmagnetic materials, which are the materials of the aluminum nitride layers 12A, are thus held between such soft magnetic particles 11A.

Figure 3A:
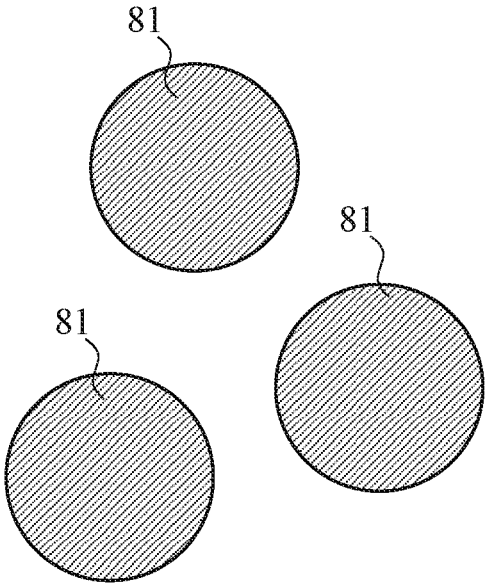
FIGS. 3A to 3C are schematic views illustrating a method for producing the conventional compressed powder core; specifically.
Figure 3B:
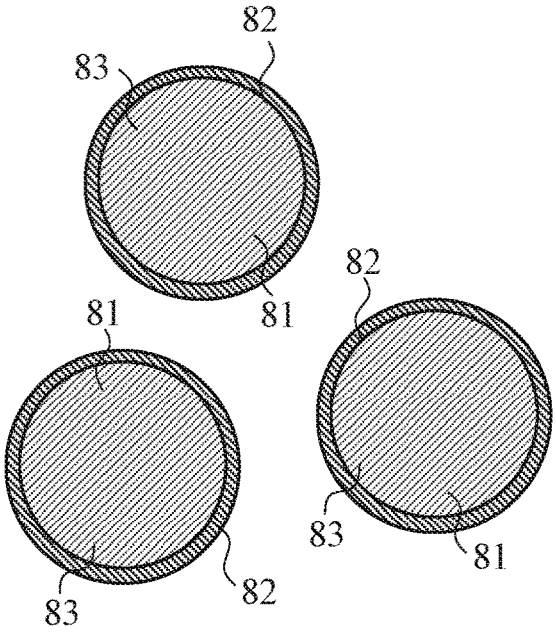
Figure 3C:
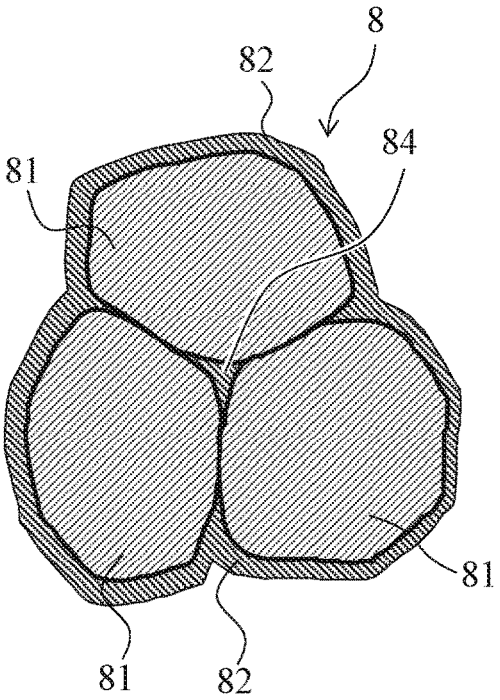

Conventionally, as illustrated in FIGS. 3A and 3B, a compressed powder core 8 illustrated in FIG. 3C has been produced from an aggregate of powders 83 for the compressed powder core each obtained by covering the surface of a soft magnetic powder 81 with a soft resin film 82 of silicone resin or the like.

Herein, the inductance L of the compressed powder core (i.e., reactor) is represented as $L=n\cdot S\cdot\mu'$ (where n represents the number of turns in a coil, S represents the cross section of the compressed powder core at a portion around which the coil is wound, and μ' represents the differential relative permeability). In order to maintain the characteristics of the inductance L of the compressed powder core when a high magnetic field is applied, it is important to suppress a decrease in the differential relative permeability when a high magnetic field is applied.

Figure 4A:
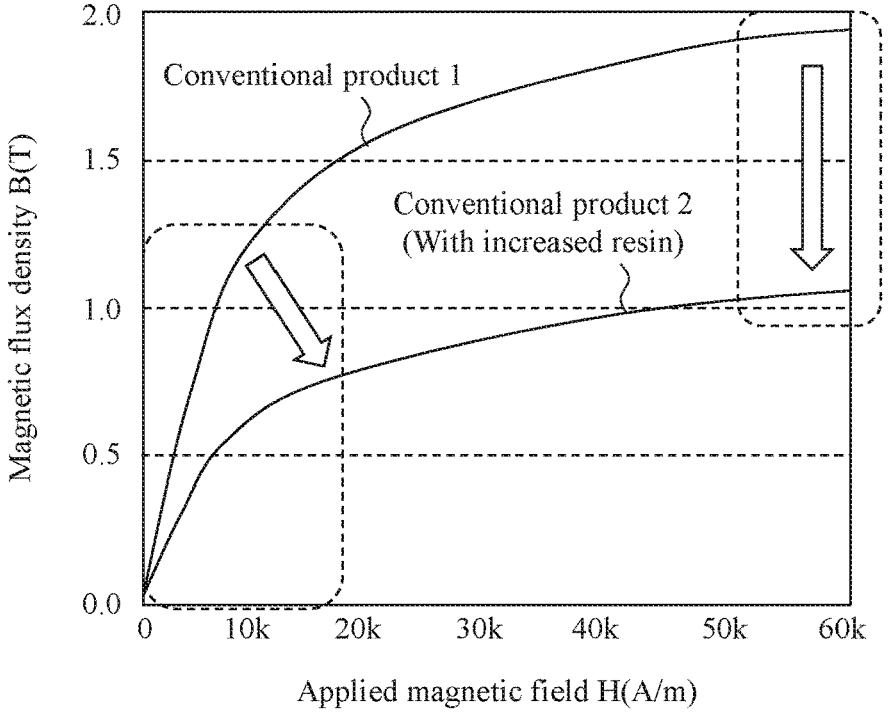
FIG. 4A is a graph illustrating the relationship between the applied magnetic field and the magnetic flux density of each of Conventional Product 1 and Conventional Product 2, which has an increased resin content than that of Conventional Product 1.

However, when a magnetic field of a low level to a high level is applied to the compressed powder core 8 illustrated in FIG. 3C, the magnetic flux density becomes close to the saturation magnetic flux density and the differential relative permeability becomes low at a high magnetic field (a magnetic field of over 40 kA/m), which are undesirable (see Conventional Product 1 in FIG. 4A).

Figure 4B:
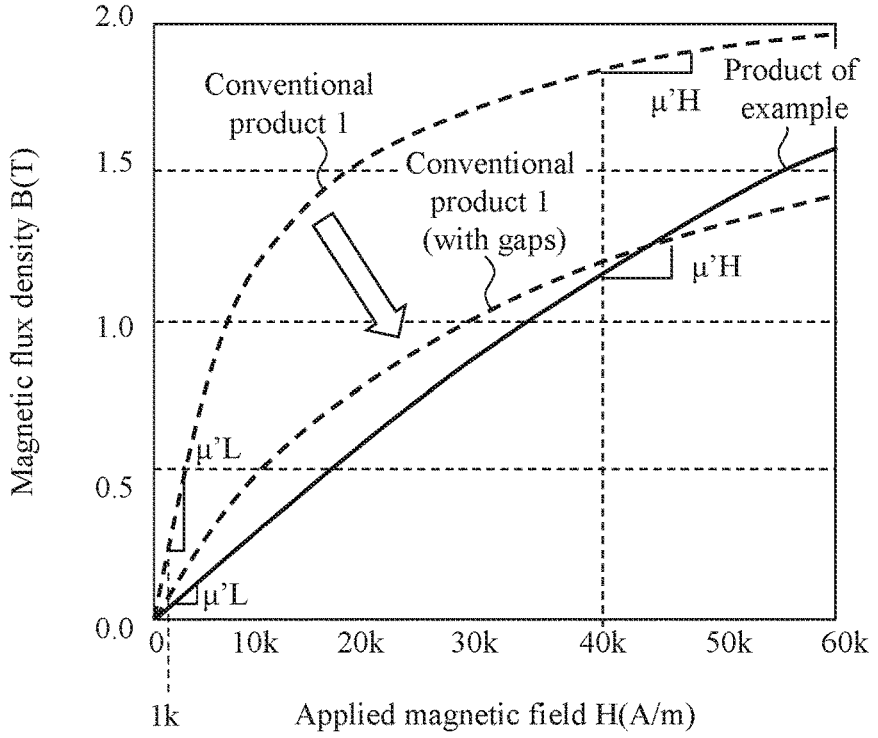
FIG. 4B is a graph illustrating the relationship between the applied magnetic field and the magnetic flux density of each of Conventional Product 1 and a product of Example of the present invention.

Herein, if the thickness of the resin film 82 illustrated in FIG. 3C is increased (if the proportion of resin is increased), the content of the resin, which is a nonmagnetic component, is increased, whereby the differential relative permeability when a low magnetic field is applied can be reduced as in Conventional Product 2 in FIG. 4B. Accordingly, it is possible to suppress the fluctuations in the inductance L of the compressed powder core even when a magnetic field of a low level to a high level is applied. However, such an increase in the resin content can also decrease the saturation magnetic flux density of the compressed powder core 8 when a high magnetic field is applied.

This is considered to be due to the reason that when a molded body is formed using powders 80 for a compressed powder core as illustrated in FIG. 3C, resin that forms the resin films 82 is unevenly and excessively distributed at the boundary portion 84 of the three soft magnetic powders 81 of the powders for the compressed powder core and the like.

Figure 13A:
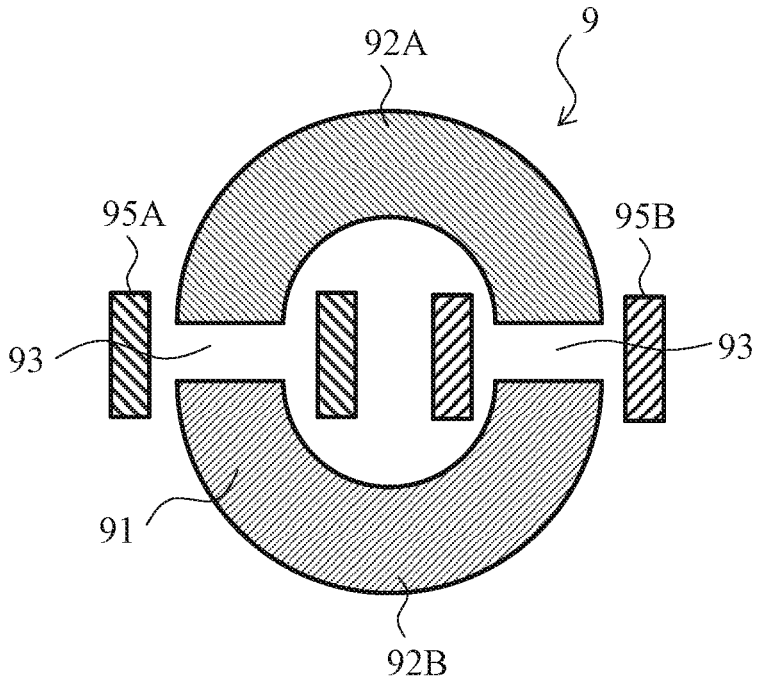
FIG. 13A is a schematic view of the conventional reactor.
Figure 13B:
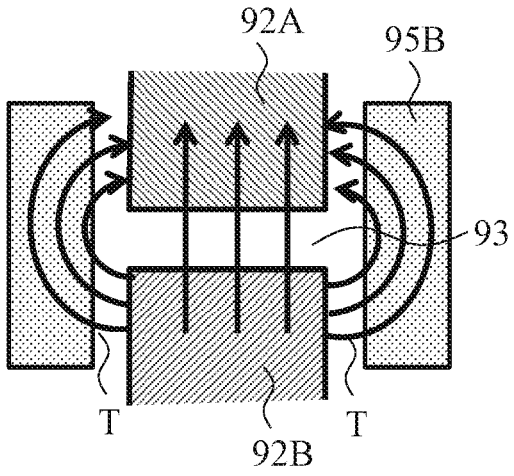
FIG. 13B is an enlarged view of a primary part thereof.

In view of the above, it is also considered that providing Conventional Product 1 (core) with the gaps 93 as illustrated in FIG. 13A may be able to reduce the magnetic flux density when a low magnetic field is applied and reduce a decrease in the differential relative permeability when a high magnetic field is applied as illustrated in Conventional Product 1 (with gaps) in FIG. 4B. However, when such gaps 93 are provided, a leakage of the magnetic flux T from the gaps 93 would increase, and the leaked magnetic flux would be linked with the coils 95A and 95B, which can result in the generation of an eddy current loss in the coil, as illustrated in FIG. 13B.

Thus, in this embodiment, the aluminum nitride layer 12A, which is harder than the base material 13A, is provided on the surface layer of each soft magnetic particle 11A as illustrated in FIG. 1D. Accordingly, it is possible to secure the distance between the soft magnetic particles 11A, 11A after molding and thus hold nonmagnetic materials, which are the materials of the aluminum nitride layers 12A, between the soft magnetic particles 11A, 11A.

The thus obtained compressed powder core 1A has, provided that the differential relative permeability when a magnetic field of 1 kA/m is applied is represented by a first differential relative permeability μ'L and the differential relative permeability when a magnetic field of 40 kA/m is applied is represented by a second differential relative permeability μ'H, a ratio of μ'L to μ'H satisfying a relationship of $\mu'L/\mu'H\leq 6$, and has a magnetic flux density of greater than or equal to 1.4 T when a magnetic field of 60 kA/m is applied.

Accordingly, as illustrated in the product of Example of the present invention in FIG. 4B, even when a magnetic field of a low level (1 kA/m) to a high level (40 kA/m) is applied to the compressed powder core, it is possible to suppress a decrease in the differential relative permeability when a high magnetic field is applied. Accordingly, it is possible to maintain the inductance of the compressed powder core (i.e., reactor) in the region of the applied magnetic field. As described above, in this embodiment, it is not necessary to provide large gaps 93 between the split cores 92A and 92B unlike in the conventional art illustrated in FIG. 13A. Thus, it is possible to suppress the generation of a leakage of a magnetic flux of the reactor.

Further, as the soft magnetic particles 11A of the compressed powder core 1A contain Si in the range of 1.0 to 3.0 mass %, it is possible to reduce an iron loss of the compressed powder core 1A while securing the strength of the compressed powder core 1A as is obvious from the experiments conducted by the inventors described below. That is, if the Si content is less than 1.0 mass %, an iron loss of the compressed powder core 1A would increase. Meanwhile, if the Si content is over 3.0 mass %, the aluminum nitride layers 12A would not be formed sufficiently (the layers would be thin and intermittent) in the process of producing the powders 1 for the compressed powder core. Therefore, sufficient compatibility between the low-melting glass layer 14A and the aluminum nitride layers 12A cannot be obtained, and the strength of the compressed powder core 1A would thus decrease.

In addition, the soft magnetic particles 11A have, when analyzed using XRD, a peak area ratio Sal/Sfe, which is the ratio of the area Sal of the peak waveform derived from AlN to the area Sfe of the peak waveform derived from Fe, satisfying a relationship of greater than or equal to 4%. Accordingly, as the aluminum nitride layers 12A can be sufficiently thick, the compatibility between the low-melting glass layer 14A and the aluminum nitride layers 12A becomes sufficient, and the strength of the compressed powder core 1A can thus be secured.

EXAMPLES

The following invention will be described on the basis of Examples.

Example 1

<Production of Powders for a Compressed Powder Core>

Water atomized powders of an iron-silicon-aluminum alloy, which contains Fe with 1.50 mass % Si and 3.55 mass % Al, (Fe-1.50Si-3.55Al), were prepared as soft magnetic powders (the maximum particle diameter: 180 μm, and particles with particle diameters of less than or equal to 45 μm were contained by 30 mass % (measured with a testing sieve defined by JIS-Z8801)). It should be noted that the Al ratio, which is the proportion of Al relative to the total mass of Al and Si in the soft magnetic powders, is 0.70 in terms of mass %.

Next, nitriding treatment was performed on the soft magnetic powders by applying heat at 1100° C. for 5 hours under a nitrogen gas atmosphere (i.e., a 100 volume % nitrogen gas) with a nitrogen gas pressure of 110 KPa. Accordingly, an aluminum nitride layer was formed as an insulating layer on the surface of each soft magnetic powder. It should be noted that an aggregate of the nitrided soft magnetic powders was found to have, when analyzed using XRD, a peak area ratio Sal/Sfe, which is the ratio of the area Sal of the peak waveform derived from AlN to the area Sfe of the peak waveform derived from Fe, of 7.8%. This corresponds to a layer thickness of 917 nm as measured through Auger spectroscopy analysis (AES). The nitrogen content relative to the powders for the compressed powder core was 0.6 mass %.

It should be noted that the XRD analysis was conducted with a Cu tube, a tube voltage of 50 kV, a tube current of 300 mA, a measurement method of FT (i.e., step scanning method), a step angle of 0.004 degrees, and a feed speed of up to 1 second/step, In addition, the Auger spectroscopy analysis (AES) was conducted with an accelerating voltage of 10 kV, an irradiation current of 10 nA, a sample inclination angle of 30 degrees, and measurement of the layer thickness (film thickness measurement) performed in terms of $SiO_2$.

<Production of Ring Specimens (i.e., Compressed Powder Cores)>

Next, $SiO_2$—$B_2O_3$—ZnO-based low-melting glass (with a softening point of 590° C.) was prepared as low-melting glass with a softening point lower than the annealing temperature (750° C.) for annealing the compressed powder core, and was added to the nitrided powders for the compressed powder core by 1.0 mass % and thus mixed, and then, the mixture was poured into a molding die.

The powders for the compressed powder core were poured into the molding die so that a ring-shaped compressed powder molded body with an outside diameter of 39 mm, an inside diameter of 30 mm, and a thickness of 5 mm was produced using warm die lubrication molding under the conditions of a molding die temperature of 130° C. and a molding pressure of 10 t/cm$^2$. The thus molded compressed powder molded body was annealed (sintered) at 750° C., for 30 minutes under a nitrogen atmosphere. Accordingly, a ring specimen (i.e., compressed powder core) was produced.

Example 2

A ring specimen (i.e., compressed powder core) was produced as in Example 1. Example 2 differs from Example 1 in using, as shown in Table 1, water atomized powders of an iron-silicon-aluminum alloy, which contains Fe with 1.78 mass % Si and 3.65 mass % Al (Fe-1.78Si-3.65Al), as soft magnetic powders. Thus, the Al ratio of the soft magnetic powders is 0.67.

The nitrided powders for the compressed powder core were found to have, when analyzed using XRD, a peak area ratio Sal/Sfe of 5.6%. This corresponds to a layer thickness of 923 nm. In addition, the nitrogen content relative to the powders for the compressed powder core was 0.6 mass %.

Example 3

A ring specimen (i.e., compressed powder core) was produced as in Example 1. Example 3 differs from Example 1 in using, as shown in Table 1, water atomized powders of an iron-silicon-aluminum alloy, which contains Fe with 2.08 mass % Si and 3.21 mass % Al (Fe-2.08Si-3.65Al), as soft magnetic powders. Thus, the Al ratio of the soft magnetic powders is 0.61.

The nitrided powders for the compressed powder core were found to have, when analyzed using XRD, a peak area ratio Sal/Sfe of 6.2%. This corresponds to a layer thickness of 801 nm. In addition, the nitrogen content relative to the powders for the compressed powder core was 0.6 mass %.

Example 4

A ring specimen (i.e., compressed powder core) was produced as in Example 1. Example 4 differs from Example 1 in using, as shown in Table 1, water atomized powders of an iron-silicon-aluminum alloy, which contains Fe with 2.80 mass % Si and 3.49 mass % Al (Fe-2.80Si-3.49Al), as soft magnetic powders. Thus, the Al ratio of the soft magnetic powders is 0.55.

The nitrided powders for the compressed powder core were found to have, when analyzed using XRD, a peak area ratio Sal/Sfe of 4.2%. This corresponds to a layer thickness of 580 nm. In addition, the nitrogen content relative to the powders for the compressed powder core was 0.5 mass %.

Comparative Example 1

A ring specimen (i.e., compressed powder core) was produced as in Example 1. Comparative Example 1 differs from Example 1 in using powders for a compressed powder core that have been obtained by using iron-silicon in which Fe contains 3 mass % Si (Fe-3.00Si) as soft magnetic powders and, without applying nitriding treatment thereto, adding 0.5 mass % silicone resin and thus depositing silicone resin films over the soft magnetic powders under the conditions of a film-deposition temperature of 130° C. and a film-deposition time of 130 minutes.

Comparative Example 2

A ring specimen (i.e., compressed powder core) was produced as in Example 1. Comparative Example 2 differs from Example 1 in using powders for a compressed powder core that have been obtained by using iron-silicon in which Fe contains 3 mass % (i Si (Fe-3.00Si) as soft magnetic powders and, without applying nitriding treatment thereto, adding 2.5 mass % silicone resin and thus depositing silicone resin films over the soft magnetic powders under the conditions of a film-deposition temperature of 130° C. and a film-deposition time of 130 minutes.

Comparative Example 3

In Comparative Example 3, as shown in Table 1, soft magnetic powders of an iron-silicon alloy, which contains Fe with 3.00 mass % Si (Fe-3.00Si), were prepared as soft magnetic powders forming soft magnetic particles, and the soft magnetic powders were mixed with polyphenylene sulfide (PPS) resin such that the content of the PPS resin became 70 volume %, and then, injection molding was performed to produce a ring specimen with the same size and shape as those in Example 1.

Comparative Example 4

A ring specimen (i.e., compressed powder core) was produced as in Example 1. Comparative Example 4 differs from Example 1 in using, as shown in Table 1, water atomized powders of an iron-silicon-aluminum alloy, which contains Fe with 0.55 mass % Si and 3.45 mass % Al (Fe-0.55Si-3.45Al), as soft magnetic powders. Thus, the Al ratio of the soft magnetic powders is 0.86.

The nitrided powders for the compressed powder core were found to have, when analyzed using XRD, a peak area ratio Sal/Sfe of 13.0%. This corresponds to a layer thickness of 1283 nm. In addition, the nitrogen content relative to the powders for the compressed powder core was 1.1 mass %.

Comparative Example 5

A ring specimen (i.e., compressed powder core) was produced as in Example 1. Comparative Example 5 differs from Example 1 in using, as shown in Table 1, water atomized powders of an iron-silicon-aluminum alloy, which contains Fe with 3.15 mass % Si and 3.49 mass % Al (Fe-3.15Si-3.49Al), as soft magnetic powders. Thus, the Al ratio of the soft magnetic powders is 0.53.

The nitrided powders for the compressed powder core were found to have, when analyzed using XRD, a peak area ratio Sal/Sfe of 2.3%. This corresponds to a layer thickness of 280 nm. In addition, the nitrogen content relative to the powders for the compressed powder core was 0.4 mass %.

Comparative Example 6

A ring specimen (i.e., compressed powder core) was produced as in Example 1. Comparative Example 6 differs from Example 1 in using, as shown in Table 1, water atomized powders of an iron-silicon-aluminum alloy, which contains Fe with 4.11 mass % Si and 3.50 mass % Al (Fe-4.11Si-3.50Al), as soft magnetic powders. Thus, the Al ratio of the soft magnetic powders is 0.46.

The nitrided powders for the compressed powder core were found to have, when analyzed using XRD, a peak area ratio Sal/Sfe of 3.4%. This corresponds to a layer thickness of 280 nm. In addition, the nitrogen content relative to the powders for the compressed powder core was 0.4 mass %.

Comparative Example 7

A ring specimen (i.e., compressed powder core) was produced as in Example 1. Comparative Example 7 differs from Example 1 in using, as shown in Table 1, water atomized powders of an iron-silicon-aluminum alloy, which contains Fe with 3.00 mass % Si and 3.50 mass % Al (Fe-3.00Si-3.50Al), as soft magnetic powders. Thus, the Al ratio of the soft magnetic powders is 0.54. Further, in Comparative Example 7, the compressed powder core was molded under the same conditions as those in Example 1 without adding low-melting glass.

Comparative Example 8

A ring specimen (i.e., compressed powder core) was attempted to be produced as in Example 1. Comparative Example 8 differs from Example 1 in using, as shown in Table 1, water atomized powders of an iron-silicon-aluminum alloy, which contains Fe with 6.00 mass % Si and 1.60 mass % Al (Fe-6.00Si-1.60Al), as soft magnetic powders. Herein, although nitriding treatment was applied to the soft magnetic powders as in Example 1, aluminum nitride layers were not formed on the surfaces thereof. Therefore, in Comparative Example 8, the test was finished at this point and the production of a compressed powder core failed.

TABLE 1

| | Soft Magnetic Powders | | | Soft Magnetic Powders after Nitriding Treatment | | | |
|---|---|---|---|---|---|---|---|
| | | | | Layer | | | |
| | Si [mass %] | Al [mass %] | Al Ratio | Thickness [nm] | Peak Area Ratio [%] | N Content [mass %] | Binder |
| Example 1 | 1.50 | 3.55 | 0.70 | 917 | 7.8 | 0.6 | Glass |
| Example 2 | 1.78 | 3.65 | 0.67 | 923 | 5.6 | 0.6 | Glass |
| Example 3 | 2.08 | 3.21 | 0.61 | 801 | 6.2 | 0.6 | Glass |
| Example 4 | 2.80 | 3.49 | 0.55 | 580 | 4.2 | 0.5 | Glass |
| Comparative Example 1 | 3.00 | 0 | — | — | — | — | Si Resin |
| Comparative Example 2 | 3.00 | 0 | — | — | — | — | Si Resin |
| Comparative Example 3 | 3.00 | 0 | — | — | — | — | PPS Resin |
| Comparative Example 4 | 0.55 | 3.45 | 0.86 | 1283 | 13.0 | 1.1 | Glass |
| Comparative Example 5 | 3.15 | 3.49 | 0.53 | 280 | 2.3 | 0.4 | Glass |
| Comparative Example 6 | 4.11 | 3.50 | 0.46 | 434 | 3.4 | 0.4 | Glass |
| Comparative Example 7 | 3.00 | 3.50 | 0.54 | — | _ | 0.4 | None |
| Comparative Example 8 | 6.00 | 1.60 | 0.21 | — | — | — | — |

<Density of the ring specimen>

The mass of the ring specimen in accordance with each of Examples 1 to 4 and Comparative Examples 1 to 7 was measured, and the density of the ring specimen was also measured from the measured mass and the volume of the ring specimen. Table 2 shows the results.

<Measurement of μ'L/μ'H and the Magnetic Flux Density>

450 turns (on the magnetization side) and 90 turns (on the detection side) of coils were wound around each of the produced ring specimens of Examples to 1 to 4 and Comparative Examples 1 to 6, and electric current was flowed through the coils, so that the magnetic flux density when a magnetic field was applied such that the magnetic field linearly increased to an level of 0 to 60 kA/m was measured using a DC magnetic-flux meter.

From the obtained graph of the applied magnetic field and the magnetic flux density (i.e., a B-H line graph), the first differential relative permeability μ'L at when a magnetic field of 1 kA/m was applied and the second differential relative permeability μ'H when a magnetic field of 40 kA/m was applied were calculated, and then, μ'L/μ'H were calculated from them. Table 2 shows the results of μ'L/μ'H. In addition, the magnetic flux density of each of the ring specimens in accordance with Examples to 1 to 4 and Comparative Examples 1 to 6 when a magnetic field of H=60 kA/m was applied was also measured. Table 2 shows the results.

It should be noted that the first differential relative permeability μ'L was calculated by, in the B-H curve shown in FIG. 4B, calculating the gradient (ΔB/ΔG) of a straight line connecting two points around the applied magnetic field of 1 kA/m across the applied magnetic field of 1 kA/m and dividing the gradient by the space permeability. Likewise, the second differential relative permeability μ'H was calculated by, in the B-H curve shown in FIG. 4B, calculating the gradient (ΔB/ΔH) of a straight line connecting two points around the applied magnetic field of 40 kA/m across the applied magnetic field of 40 kA/m and dividing the gradient by the space permeability. μ'L/μ'H is the value of the first differential relative permeability μ'L/the second differential relative permeability μ'H.

<Measurement of the Strength>

The radial crushing strength of each of the ring specimens in accordance with Examples 1 to 4 and Comparative Examples 1 to 7 was measured as the strength in accordance with the "Sintered metal bearing-Determination of radial crushing strength" of JIS Z 2507. Table 2 shows the results.

<Measurement of the Inductance>

Further, 90 turns (for detection) and 90 turns (for winding) of coils were wound around each of the ring specimens of Examples to 1 to 4 and Comparative Examples 1 to 7, and the inductance was measured with an AC BH analyzer under the conditions of I=10 mA. Table 2 shows the results.

<Measurement of an Iron Loss>

90 turns (for magnetization) and 90 turns (for detection) of coils were wound around each of the ring specimens of Examples to 1 to 4 and Comparative Examples 1 to 7 using copper wires of φ0.5 mm, and an iron loss at 0.1 T and 20 kHz was measured with an AC BH analyzer. Table 2 shows the results.

TABLE 2

| | Density [g/cm$^3$] | Magnetic Flux Density [T] when H = 60 kA/m | μ'L/μ'H | Strength [MPa] | Inductance [μH/cm$^2$] | Iron Loss [kW/m$^3$] |
|---|---|---|---|---|---|---|
| Example 1 | 6.67 | 1.56 | 4.5 | 72 | 392 | 276 |
| Example 2 | 6.59 | 1.52 | 4.3 | 66 | 381 | 267 |
| Example 3 | 6.62 | 1.56 | 4.4 | 82 | 385 | 259 |
| Example 4 | 6.51 | 1.48 | 5.7 | 62 | 410 | 278 |
| Comparative Example 1 | 7.29 | 2.15 | 37.1 | 37 | 1381 | 296 |
| Comparative Example 2 | 6.84 | 1.88 | 14.2 | 51 | 1150 | 290 |
| Comparative Example 3 | 5.51 | 0.70 | 1.6 | 46 | 250 | 453 |
| Comparative Example 4 | 6.81 | 1.54 | 3.1 | 91 | 331 | 403 |
| Comparative Example 5 | 6.58 | 1.54 | 7.7 | 45 | 514 | 256 |
| Comparative Example 6 | 6.24 | 1.35 | 6.8 | 46 | 418 | 263 |
| Comparative Example 7 | 6.65 | — | — | 16 | 421 | 296 |

[Result 1: Regarding μ'L/μ'H and the Magnetic Flux Density]

Figure 5:
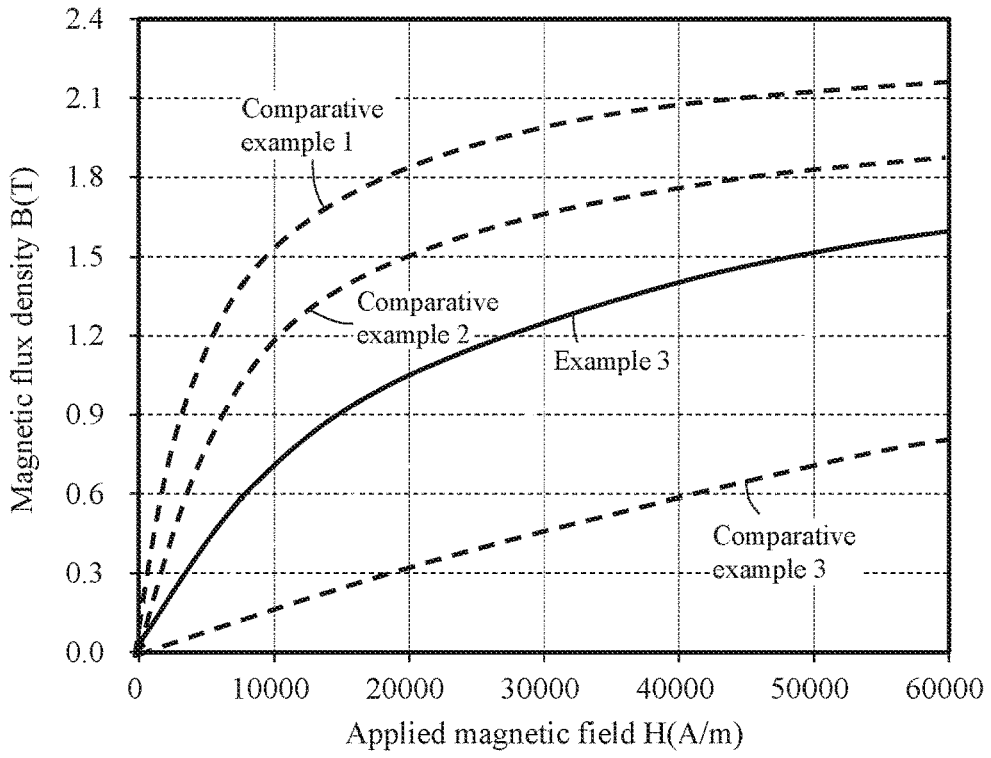
FIG. 5 is a B-H line graph of each of compressed powder cores in accordance with Example 3 and Comparative Examples 1 to 3.
Figure 6:
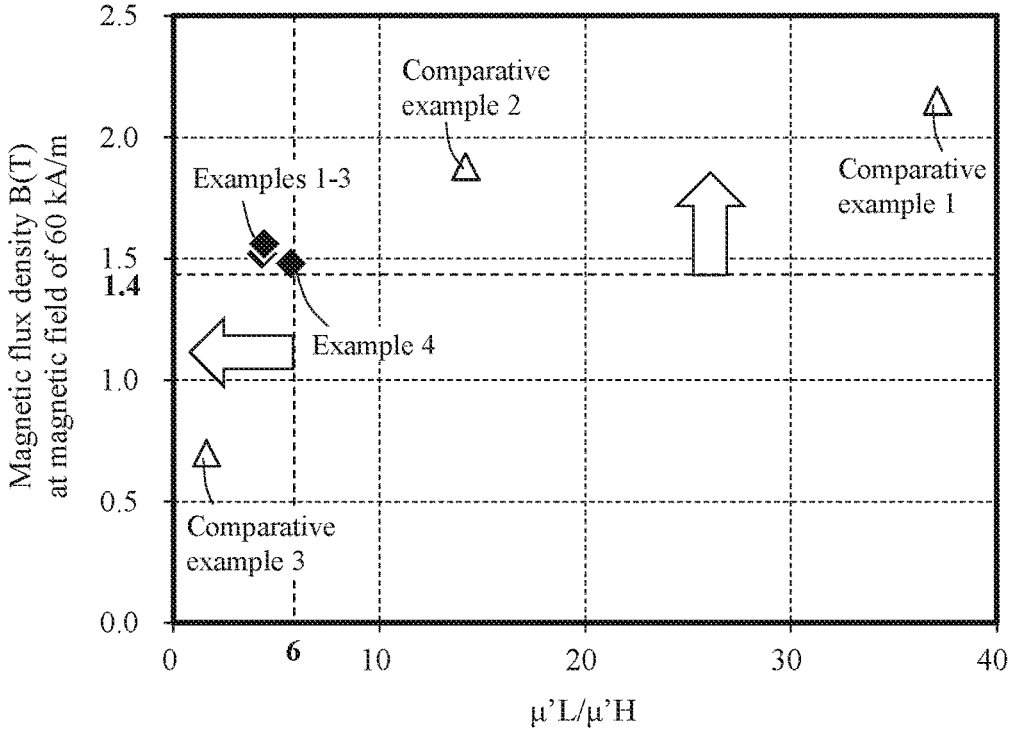
FIG. 6 is a graph illustrating the relationship between μ'L/μ'H of each of compressed powder cores in accordance with Examples 1 to 4 and Comparative Examples 1 to 3 and the magnetic flux density B thereof when a magnetic field of 60 kA/m is applied.

As illustrated in FIGS. 5 and 6, with respect to each of the compressed powder cores in accordance with Examples 1 to 4, the ratio μ'L/μ'H of the first differential relative permeability μ'L to the second differential relative permeability μ'H is less than or equal to 6, which is obviously lower than those of Comparative Examples 1 and 2. That is, it is recognized that the compressed powder cores in accordance with Examples 1 to 4 are compressed powder cores in which a decrease in the differential relative permeability when a high magnetic field is applied is suppressed as compared to those of Comparative Examples 1 and 2.

This is considered to be due to the following reason. For each of the compressed powder cores of Examples 1 to 4, powders for a compressed powder core, which have been obtained by forming insulating layers of aluminum nitride on soft magnetic powders, were used. Thus, the insulating layers are less likely to flow during powder compression molding in comparison with the powders of Comparative Examples 1 and 2 that were obtained by using silicone resin for the resin films (insulating films). Accordingly, it is considered that in each of the compressed powder cores of Examples 1 to 4. insulating layers (i.e., aluminum nitride layers) between the soft magnetic particles can be secured more firmly than those of Comparative Examples 1 and 2, and thus, a decrease in the differential relative permeability can be suppressed even when a high magnetic field is applied. Though not shown in FIG. 6 (as shown in Table 2), it is also considered that μ'L/μ'H of each of the compressed powder cores in accordance with Comparative Examples 4 to 6 is also obviously lower than those of Comparative Examples 1 and 2 for the same reason.

As illustrated in FIGS. 5 and 6, each of the compressed powder cores in accordance with Examples 1 to 4 has a magnetic flux density of greater than or equal to 1.4 T when a magnetic field of 60 kA/m is applied, which is obviously higher than that of Comparative Example 3. This is considered to be due to the reason that as the resin content of the compressed powder core in accordance with Comparative Example 3 is high, the distance between the soft magnetic particles is long and the resin thus resides between such soft magnetic particles, and thus that the magnetic flux density of the compressed powder core in accordance with Comparative Example 3 when a magnetic field of 60 kVm is applied is lower than those of Examples 1 to 4. Though not illustrated in FIG. 6, as is also obvious from Table 2, it is considered that the magnetic flux density of each of the compressed powder cores in accordance with Comparative Examples 4 to 6 when a magnetic field of 60 kA/m is applied is also higher than that of Comparative Example 3 for the same reason.

[Result 2: Regarding Si Content]

Figure 7:
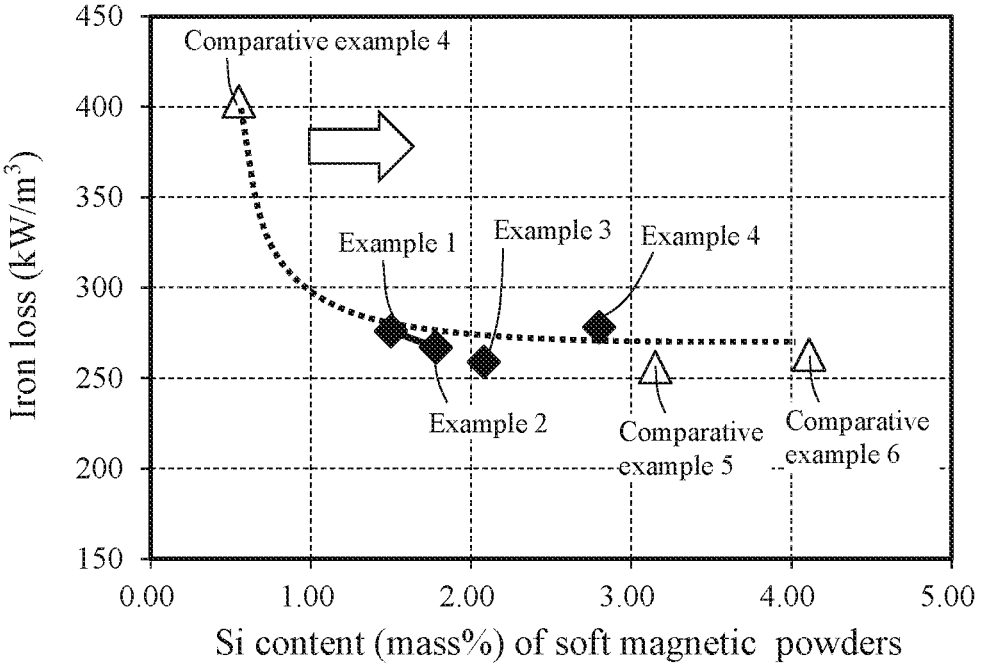
FIG. 7 is a graph illustrating the relationship between the Si content of soft magnetic powders in accordance with each of Examples 1 to 4 and Comparative Examples 4 to 6 and an iron loss of the resulting compressed powder core.

FIG. 7 is a graph illustrating the relationship between the Si content of the soft magnetic powders in accordance with each of Examples 1 to 4 and Comparative Examples 4 to 6 and an iron loss of the resulting compressed powder core. As illustrated in FIG. 7, an iron loss of the compressed powder core in accordance with each of Examples 1 to 4 and Comparative Examples 5 and 6 is smaller than that of Comparative Example 4. This is considered to be due to the reason that as the Si content of the soft magnetic powders (i.e., soft magnetic particles) of Comparative Example 4 is extremely low, the magnetocrystalline anisotropy of the base material has deteriorated and an iron loss has thus deteriorated. Therefore, it is considered that an increase in the iron loss of a compressed powder core can be suppressed as long as the content of Si in soft magnetic powders in the production of the compressed powder core as well as the content of Si in soft magnetic particles of the compressed powder core is greater than or equal to 1.0 mass %.

Figure 8:
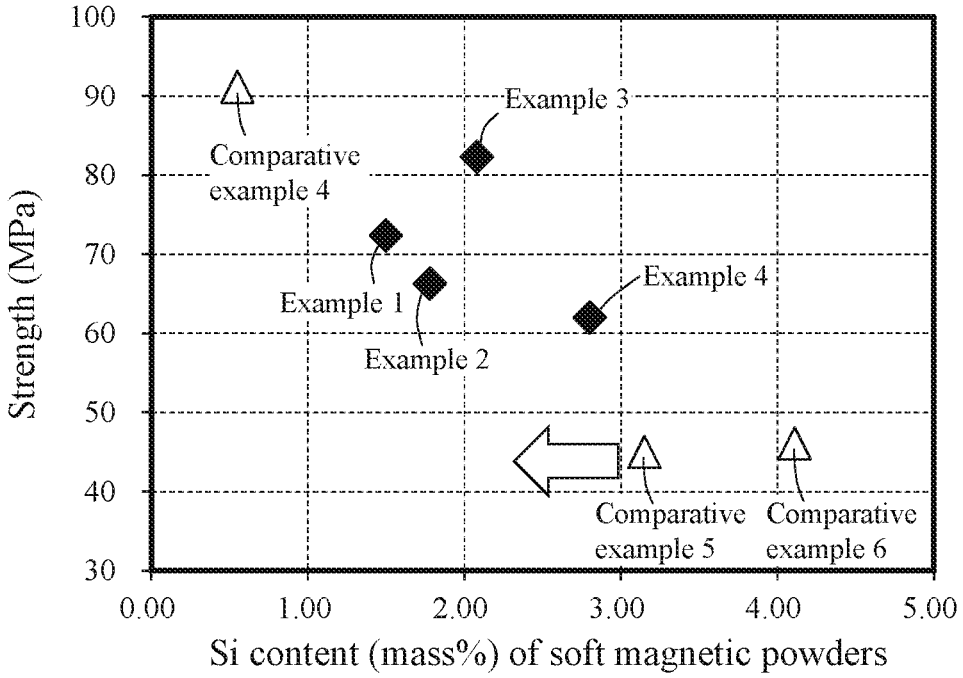
FIG. 8 is a graph illustrating the relationship between the Si content of soft magnetic powders in accordance with each of Examples 1 to 4 and Comparative Examples 4 to 6 and the strength of the resulting compressed powder core.

FIG. 8 is a graph illustrating the relationship between the Si content of the soft magnetic powders in accordance with each of Examples 1 to 4 and Comparative Examples 4 to 6 and the strength of the resulting compressed powder core. As illustrated in FIG. 8, the strength of the compressed powder core in accordance with each of Examples 1 to 4 and Comparative Example 4 is over 60 MPa, which is greater than those of Comparative Examples 5 and 6. This is considered to be due to the reason that the Si content of the soft magnetic powders in accordance with each of Comparative Examples 5 and 6 is extremely high. Therefore, it is considered that a decrease in the strength of a compressed powder core can be suppressed as long as the content of Si in soft magnetic powders in the production of the compressed powder core is less than or equal to 3.0 mass %. The detailed reason is described below together with the peak area ratio (i.e., thickness of the aluminum nitride layer).

[Result 3: Regarding the Peak Area Ratio Sal/Sfe]

Figure 9:
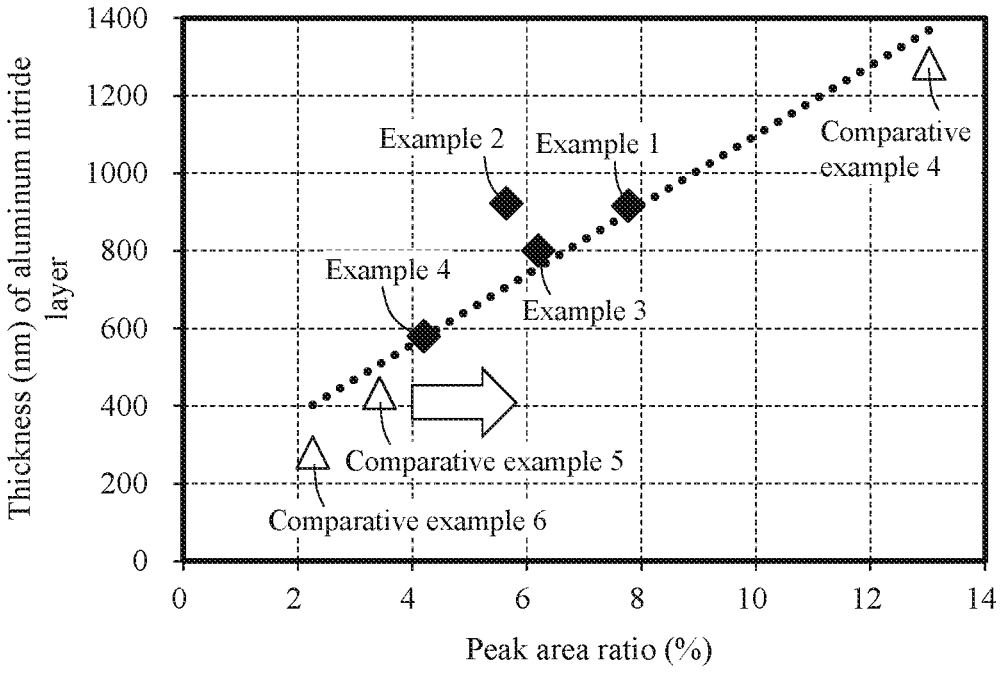
FIG. 9 is a graph illustrating the relationship between the peak area ratio of soft magnetic powders after nitriding treatment in accordance with each of Examples 1 to 4 and Comparative Examples 4 to 6 and the thickness of an aluminum nitride layer.

FIG. 9 is a graph illustrating the relationship between the peak area ratio of the soft magnetic powders after nitriding treatment in accordance with each of Examples 1 to 4 and Comparative Examples 4 to 6 and the thicknesses of the aluminum nitride layers. As is obvious from FIG. 9, it is found that the peak area ratio of the soft magnetic powders after nitriding treatment and the thicknesses of the aluminum nitride layers formed on the respective soft magnetic powders are linear-proportional to each other.

It should be noted that even in powders for the compressed powder core produced from the soft magnetic powders after nitriding treatment and in the compressed powder core, Fe in the base materials of the soft magnetic powders after nitriding treatment and the aluminum nitride layers remain without almost any change. Therefore, the peak area ratio Sal/Sfe, which is the ratio of the area Sal of the peak waveform derived from AlN to the area Sfe of the peak waveform derived from Fe, determined by analyzing the compressed powder core using XRD, is considered to be the same as the peak area ratio of the soft magnetic powders after nitriding treatment.

Figure 10A:
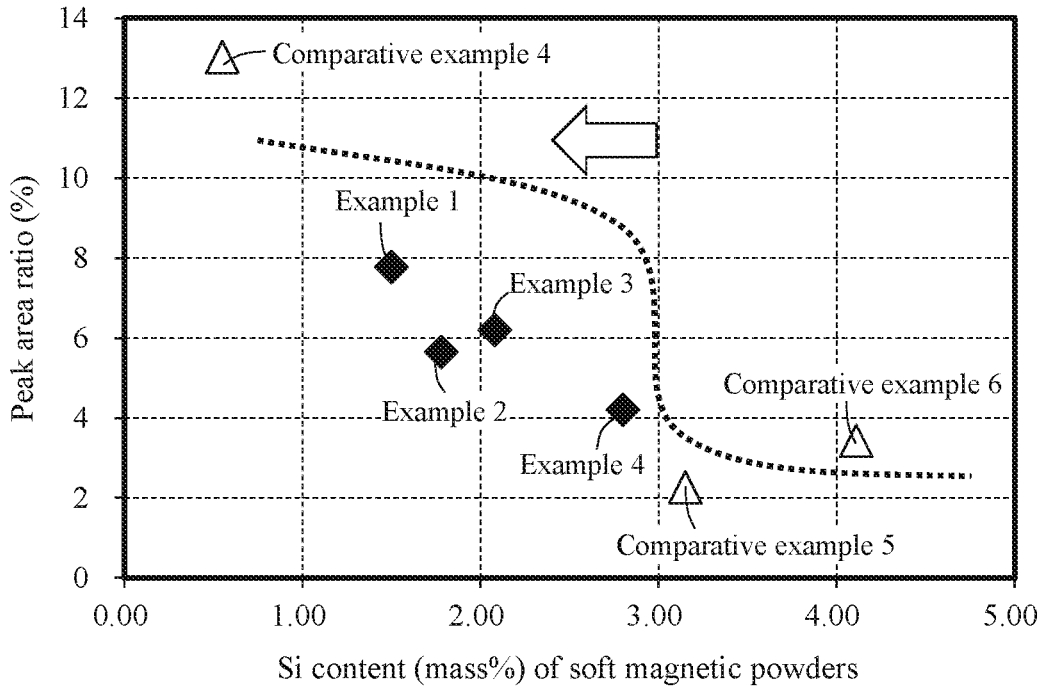
FIG. 10A is a graph illustrating the relationship between the Si content of soft magnetic powders in accordance with each of Examples 1 to 4 and Comparative Examples 4 to 6 and the peak area ratio of the soft magnetic powders after nitriding treatment.
Figure 10B:
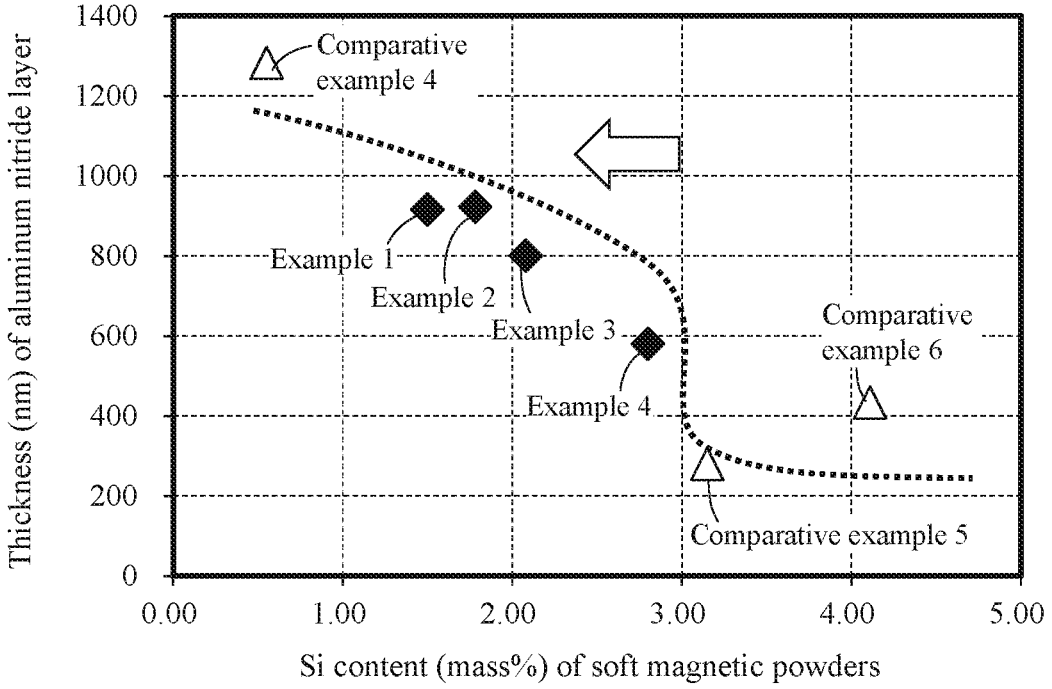
FIG. 10B is a graph illustrating the relationship between the Si content of the soft magnetic powders in accordance with each of Examples 1 to 4 and Comparative Examples 4 to 6 and the thicknesses of aluminum nitride layers of the soft magnetic powders after nitriding treatment.

FIG. 10A is a graph illustrating the relationship between the Si content of the soft magnetic powders in accordance with each of Examples 1 to 4 and Comparative Examples 4 to 6 and the peak area ratio of the soft magnetic powders after nitriding treatment, and FIG. 10B is a graph illustrating the relationship between the Si content of the soft magnetic powders in accordance with each of Examples 1 to 4 and Comparative Examples 4 to 6 and the thicknesses of aluminum nitride layers on the respective soft magnetic powders after nitriding treatment.

As illustrated in FIGS. 10A and 10B, the soft magnetic powders in accordance with each of Examples 1 to 4 and Comparative Example 4 have a higher peak area ratio of the soft magnetic powders after nitriding treatment and a larger thickness of the aluminum nitride layers on the soft magnetic powders after nitriding treatment than those of Comparative Examples 5 and 6. It is considered that stable aluminum nitride layers can be formed as long as the Si content of the soft magnetic powders is less than or equal to 3.0 mass % as in Examples 1 to 4 and Comparative Example 4.

Figure 11:
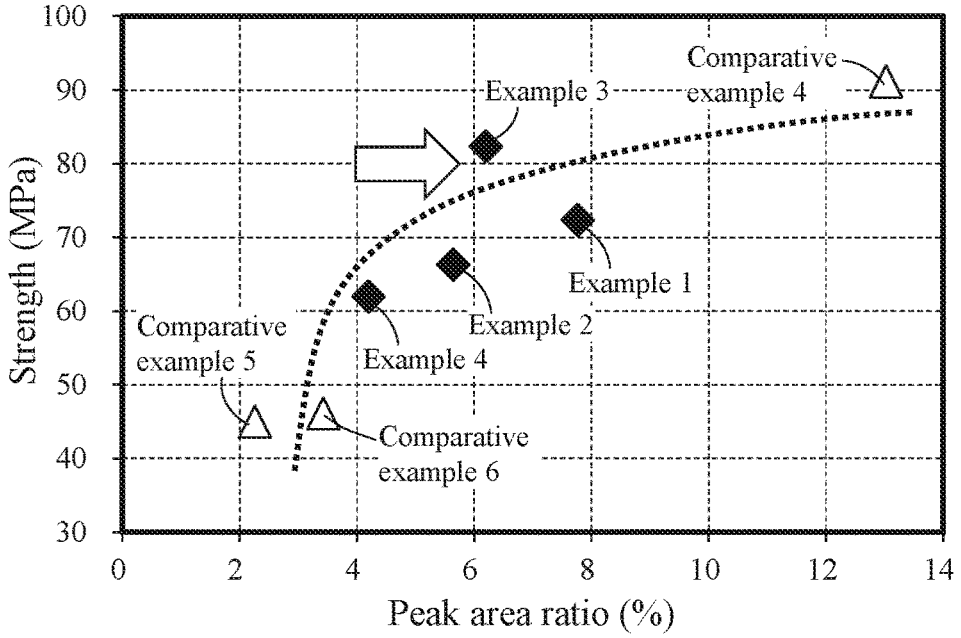
FIG. 11 is a graph illustrating the relationship between the peak area ratio of soft magnetic powders after nitriding treatment in accordance with each of Examples 1 to 4 and Comparative Examples 4 to 6 and the intensity of the resulting compressed powder core.

FIG. 11 is a graph illustrating the relationship between the peak area ratio of the soft magnetic powders after nitriding treatment in accordance with each of Examples 1 to 4 and Comparative Examples 4 to 6 and the strength of the resulting compressed powder core. As illustrated in FIG. 11, the strength of the compressed powder core in accordance with each of Examples 1 to 4 and Comparative Example 4 is over 60 MPa, which is greater than those of Comparative Examples 5 and 6. This is considered to be due to the reason that the peak area ratio of the soft magnetic powders after nitriding treatment as well as the compressed powder core in accordance with each of Examples 1 to 4 and Comparative Example 4 is higher than those of Comparative Examples 5 and 6, that is, the thickness of each aluminum nitride layer is greater.

Accordingly, it is considered that the strength of a compressed powder core can be secured as long as the peak area ratio of soft magnetic powders after nitriding treatment as well as the compressed powder core is greater than or equal to 4%, that is, as long as the thickness of each aluminum nitride layer is greater than or equal to 580 nm. That is, it is considered that as long as such conditions are satisfied, the wettability and compatibility of the low-melting glass with the stably formed aluminum nitride layers are sufficiently secured, and the strength of the compressed powder core can thus be secured.

In addition, as illustrated in FIGS. 8 and 10A and 10B, it is recognized that as long as the content of Si in soft magnetic powders during production is less than or equal to 3.0 mass %, the peak area ratio (i.e., the thickness of each aluminum nitride layer) satisfies the aforementioned range and the strength of the compressed powder core can thus be secured.

Figure 12:
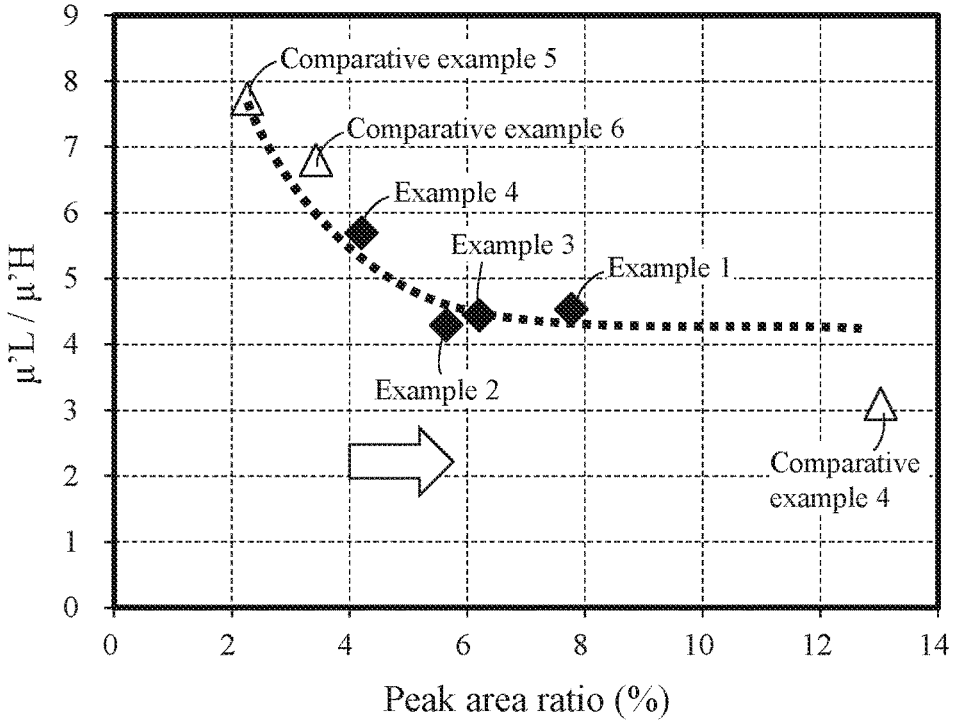
FIG. 12 is a graph illustrating the relationship between the peak area ratio of soft magnetic powders after nitriding treatment in accordance with each of Examples 1 to 4 and Comparative Examples 4 to 6 and μ'L/μ'H of the resulting compressed powder core.

FIG. 12 is a graph illustrating the relationship between the peak area ratio of the soft magnetic powders after nitriding treatment in accordance with each of Examples 1 to 4 and Comparative Examples 4 to 6 and μ'L/μ'H of the resulting compressed powder core. As illustrated in FIG. 12, it is considered that as long as the peak area ratio of the soft magnetic powders after nitriding treatment as well as the compressed powder core is greater than or equal to 4%, that is, as long as the thickness of each aluminum nitride layer is greater than or equal to 580 nm, μ'L/μ'H of the compressed powder core can be further reduced.

[Result 4: Regarding Effect of Low-Melting Glass]

As shown in Table 2, the strength of the compressed powder core in accordance with Comparative Example 7 is lower than those of Examples 1 to 4. This is considered to be due to the reason that in Comparative Example 7, soft magnetic powders were subjected to powder compression molding without using low-melting glass.

[Result 5: Regarding Al Ratio]

As shown in Table 1, in Comparative Example 8, aluminum nitride layers were not formed on the surfaces of the soft magnetic powders. This is considered to be due to the reason that in Comparative Example 8, the Al ratio of the soft magnetic powders is lower than those of Examples 1 to 4. It is also estimated that aluminum nitride layers can be formed on the surfaces of soft magnetic powders by nitriding treatment as long as the Al ratio of the soft magnetic powders is greater than or equal to 0.45, preferably greater than or equal to 0.55 as in Example 4.

<Check Test (Analysis)>

Using the data obtained from the B-H line graph measured for Examples 3 and 4 and Comparative Examples 1 to 3, a model of the reactor illustrated in FIG. 13A was supposed, and the size of the core (i.e., magnetic powder core), the gap length, and a loss were calculated so that the inductance of the reactor became constant. The loss herein is means a loss of the reactor assay, and specifically includes an iron loss (i.e., core loss), a DC loss (i.e., Joule loss) in the coil, and an eddy current loss in the coil. Table 3 below shows the results. It should be noted that Table 3 shows, with reference to the size, the number of turns in a coil, inductance, and a loss of the reactor corresponding to Comparative Example 1 as 100, the values of the other examples.

TABLE 3

| | Core Size | Number of Turns in Coil | Length of Gap (mm) | Inductance | Loss |
|---|---|---|---|---|---|
| Example 3 | 100 | 100 | 1.2 | 103 | 71 |
| Example 4 | 100 | 100 | 1.6 | 104 | 76 |
| Comparative Example 1 | 100 | 100 | 3.2 | 100 | 100 |
| Comparative Example 2 | 100 | 100 | 2.4 | 104 | 88 |
| Comparative Example 3 | 160 | 100 | 0.8 | 102 | 64 |

The results can confirm that the reactors in accordance with Comparative Examples 1 and 2 have greater losses than those of Examples 3 and 4. Meanwhile, the reactor in accordance with Comparative Example 3 has a smaller loss than those of Examples 3 and 4, but has a lower magnetic flux density than those of Examples 3 and 4. Thus, the core size in accordance with Comparative Example 3 is 1.6 times those of Examples 3 and 4.

Although the embodiments of the present invention have been described in detail above, the specific configurations are not limited thereto. Any design changes within the scope and spirit of the present invention are all included in the present invention.

What is claimed is:

1. A compressed powder core comprising soft magnetic particles each having a base material made of an Fe—Si—Al alloy and an aluminum nitride layer formed on a surface layer of the base material, and a low-melting glass layer between the soft magnetic particles, the low-melting glass layer having a softening point lower than an annealing temperature of the soft magnetic particles for annealing the compressed powder core, wherein the compressed powder core has, provided that a differential relative permeability when a magnetic field of 1 kA/m is applied is a first differential relative permeability μ'L and a differential relative permeability when a magnetic field of 40 kA/m is applied is a second differential relative permeability μ'H, a ratio of μ'L to μ'H satisfying a relationship of μ'L/μ'H ≤6, and has a magnetic flux density of greater than or equal to 1.4T when a magnetic field of 60 kA/m is applied, the soft magnetic particles contain Si in a range of 1.0 to 3.0 mass %, the compressed powder core has, when analyzed using XRD, a peak area ratio Sal/Sfe of greater than or equal to 4%, the peak area ratio Sal/Sfe being a ratio of an area Sal of a peak waveform derived from AN to an area Sfe of a peak waveform derived from Fe, an Al ratio is greater than or equal to 0.45, the Al ratio being a mass proportion of Al to a total mass of Al and Si of the soft magnetic particles, and the aluminum nitride layer is formed on the entire surface of the base material.

2. The compressed powder core according to claim 1, wherein when a total mass of the entire compressed powder core is assumed to be 100 mass %, a content of the low-melting glass that forms the low-melting glass layer is 0.05 to 5.0 mass %.

3. Powders for a compressed powder core, the powders comprising soft magnetic powders each having a base material made of an Fe—Si—Al alloy and an aluminum nitride layer formed on a surface layer of the base material, and low-melting glass films formed on surfaces of the respective soft magnetic powders, the low-melting glass films having a softening point lower than an annealing temperature of the soft magnetic powders for annealing the compressed powder core, wherein the soft magnetic powders contain, when a total mass of the entire soft magnetic powders is assumed to be 100 mass %, Si in a range of 1.0 to 3.0 mass %, the powders for the compressed powder core have, when analyzed using XRD, a peak area ratio Sal/Sfe of greater than or equal to 4%, the peak area ratio Sal/Sfe being a ratio of an area Sal of a peak waveform derived from AN to an area Sfe of a peak waveform derived from Fe, an Al ratio is greater than or equal to 0.45, the Al ratio being a mass proportion of Al to a total mass of Al and Si of the soft magnetic particles, and the aluminum nitride layer is formed on the entire surface of the base material.

4. The compressed powder core according to claim 1, wherein a thickness of the aluminum nitride layer is greater than or equal to 580 nm.

5. Powders for a compressed powder core according to claim 3, wherein a thickness of the aluminum nitride layer is greater than or equal to 580 nm.

* * * * *